US008061445B2

(12) United States Patent
Yater et al.

(10) Patent No.: US 8,061,445 B2
(45) Date of Patent: Nov. 22, 2011

(54) DRILLING FLUID PUMP SYSTEMS AND METHODS

(75) Inventors: Ronald William Yater, Houston, TX (US); Kenneth Wayne Seyffert, Houston, TX (US); Maurice Tate, Jr., Spring, TX (US)

(73) Assignee: National Oilwell Varco L.P., Houston, TX (US)

( * ) Notice: Subject to any disclaimer, the term of this patent is extended or adjusted under 35 U.S.C. 154(b) by 663 days.

(21) Appl. No.: 12/228,524

(22) Filed: Aug. 13, 2008

(65) Prior Publication Data

US 2010/0038134 A1 Feb. 18, 2010

(51) Int. Cl.
*E21B 44/00* (2006.01)

(52) U.S. Cl. ..... 175/57; 175/217

(58) Field of Classification Search ..... 166/105; 175/57, 217; 417/417, 418
See application file for complete search history.

(56) References Cited

U.S. PATENT DOCUMENTS

| | | | | |
|---|---|---|---|---|
| 2,362,631 | A | 3/1953 | Griffin et al. | |
| 2,632,631 | A * | 3/1953 | Griffin et al. | 175/66 |
| 4,145,165 | A | 3/1979 | Perkins et al. | 417/418 |
| 4,242,057 | A | 12/1980 | Bender | 417/404 |
| 4,272,226 | A | 6/1981 | Osborne | 417/418 |
| 4,295,366 | A | 10/1981 | Gibson et al. | 73/155 |
| 4,493,382 | A | 1/1985 | Collins et al. | 175/206 |
| 4,527,959 | A | 7/1985 | Whiteman | 417/342 |
| 4,676,724 | A | 6/1987 | Birdwell | 417/342 |
| 4,718,832 | A | 1/1988 | Takahashi | 417/417 |
| 5,059,101 | A | 10/1991 | Valavaara | 417/569 |
| 5,253,987 | A | 10/1993 | Harrison | 417/566 |
| 5,281,102 | A | 1/1994 | Reinhart | 417/53 |
| 5,616,009 | A | 4/1997 | Birdwell | 417/342 |
| 5,823,093 | A | 10/1998 | Kugelev et al. | 92/128 |
| 5,960,700 | A | 10/1999 | Staggs et al. | 92/240 |
| 6,102,673 | A | 8/2000 | Mott et al. | 417/392 |
| 6,230,810 | B1 | 5/2001 | Rivas | 166/357 |
| 6,864,647 | B2 | 3/2005 | Duncan et al. | 318/114 |
| 6,944,547 | B2 | 9/2005 | Womer et al. | 702/7 |
| 6,960,858 | B2 | 11/2005 | Kawai | 310/181 |
| 7,044,237 | B2 | 5/2006 | Leuchtenberg | 175/48 |
| 2004/0061583 | A1 | 4/2004 | Yumita | 336/121 |
| 2004/0219040 | A1 | 11/2004 | Kugelev et al. | 417/415 |
| 2007/0261888 | A1 | 11/2007 | Urquhart | 175/217 |

OTHER PUBLICATIONS

Drilling Equipment. Hydraulic Mud Pump; Maritime Hydraulics General Catalogue 1993-1994; 3 pp.
Varco Mud Pumps: Varco; 2 pp; 2002.
Hex Pump The Next Generation In Mud Pump Technology; National Oilwell Varco; 6 pp: 2005.
Know Your Mud Pump; TRW Mission; 8 pp.; 1975.
Premium "P" Series Offshore Triplex Pumps; National Oilwell Varco; 4 pp. 2006.
How To Treat Your Type "P" Triplex Mud Pump; National Oilwell Varco; Cover Page. pp. 10-15; 2002.

* cited by examiner

*Primary Examiner* — Daniel P Stephenson
(74) *Attorney, Agent, or Firm* — Williams, Morgan & Amerson, P.C.

(57) ABSTRACT

A system for pumping fluid (e.g., but not limited to, drilling fluid), the system having pump apparatus; including a plurality of removable pump modules; and, in certain aspects, removable valve cartridges for such modules.

23 Claims, 37 Drawing Sheets

FIG. 4A
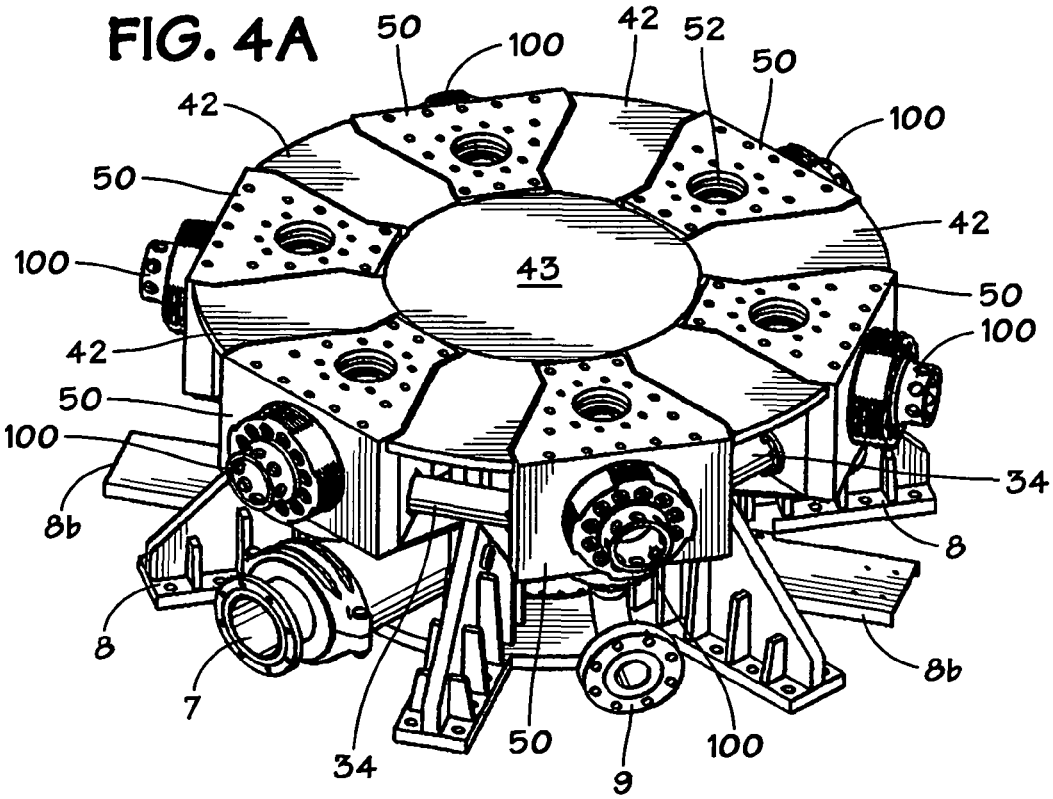
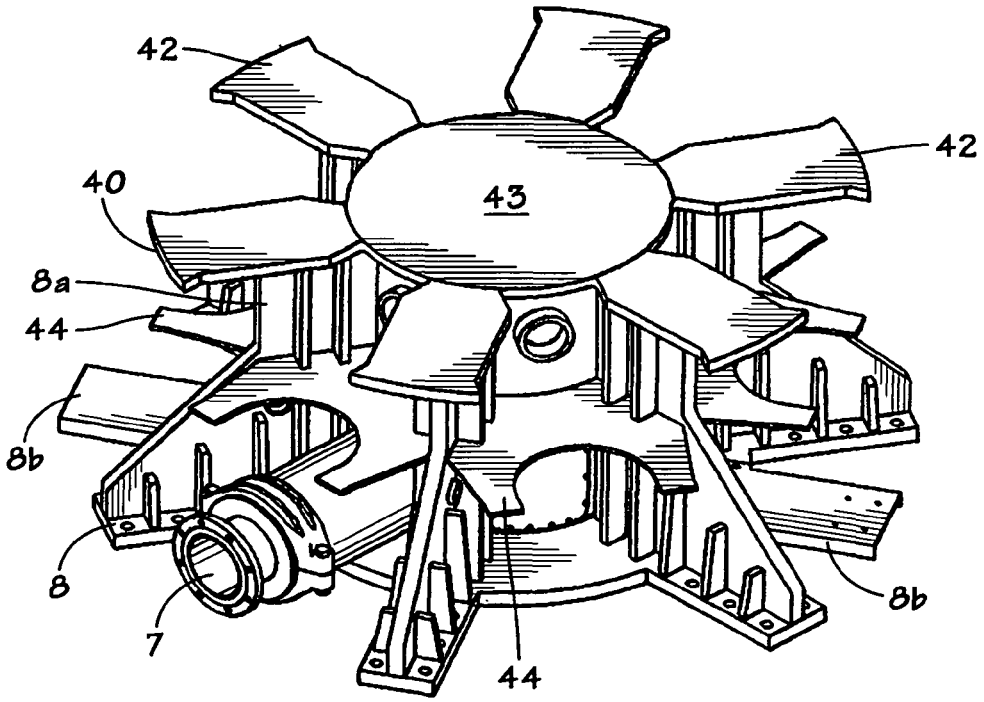
FIG. 4B

FIG. 4C
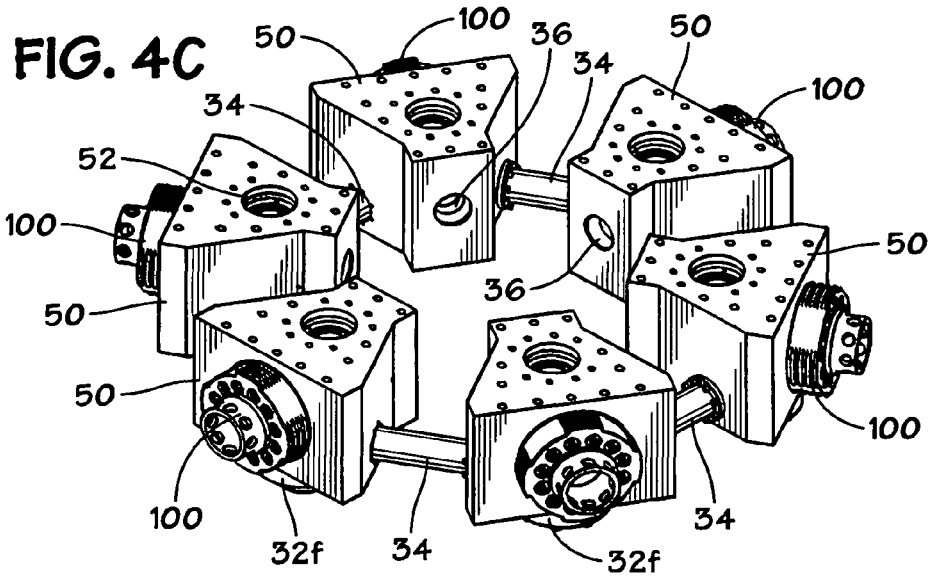
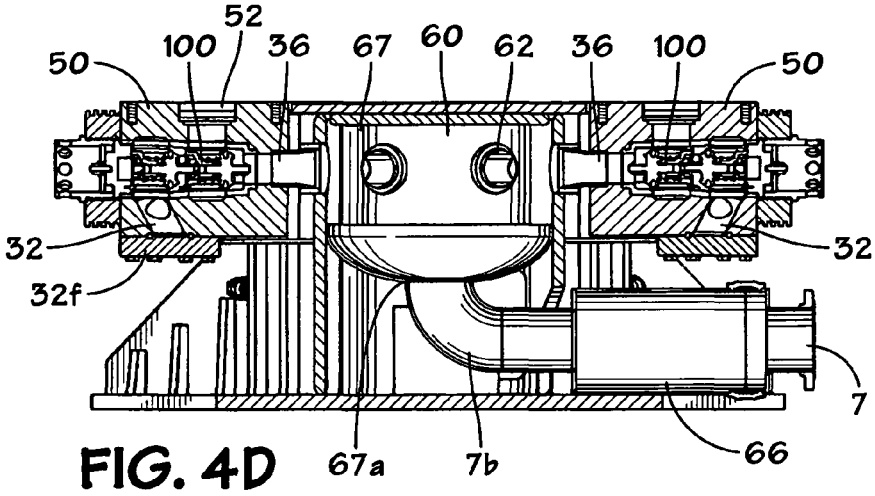
FIG. 4D
FIG. 5
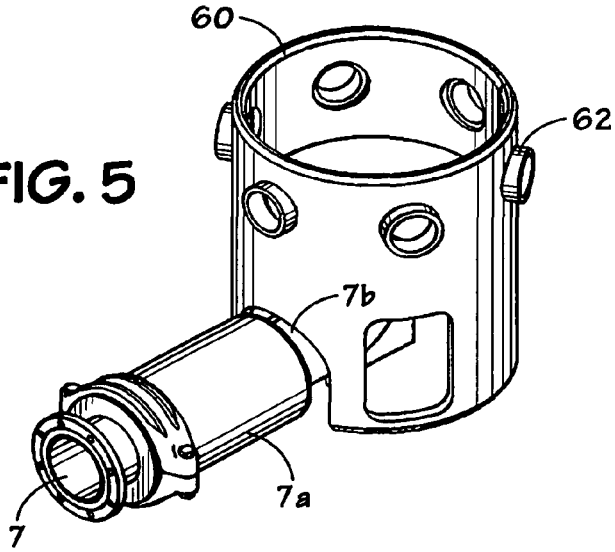

FIG. 6A
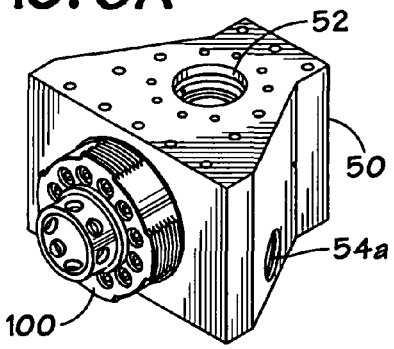
FIG. 6B
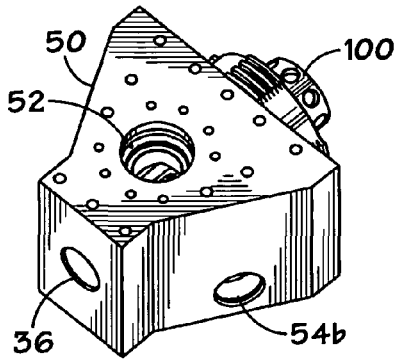
FIG. 6C
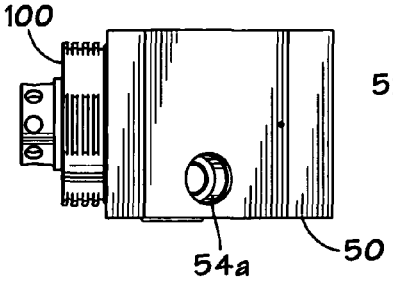
FIG. 6D
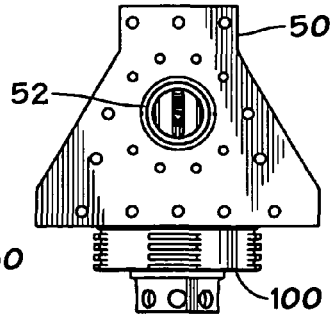
FIG. 6E
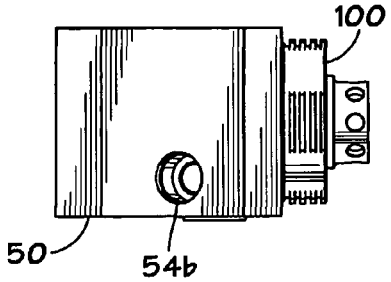
FIG. 6F
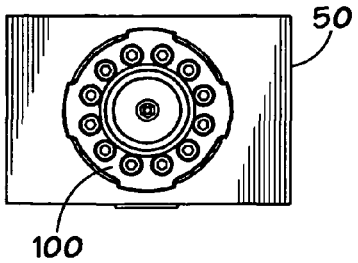
FIG. 6G
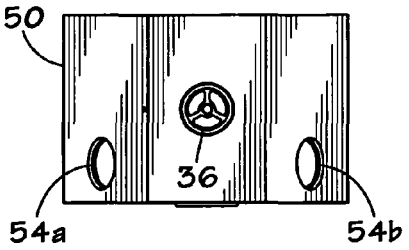
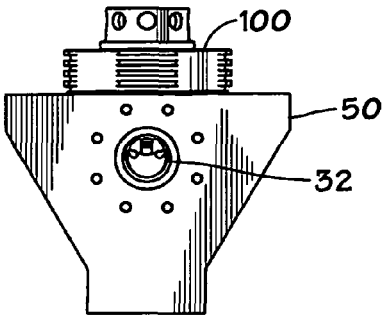
FIG. 6H FIG. 7A
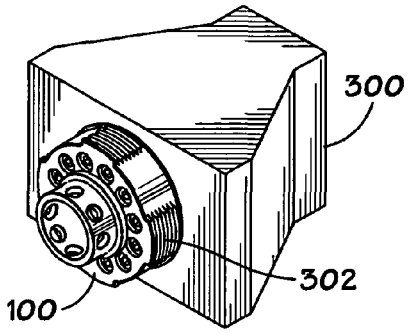
FIG. 7B
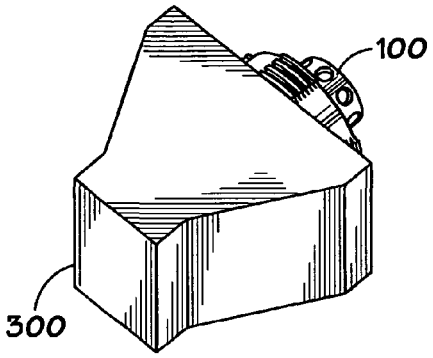
FIG. 7C
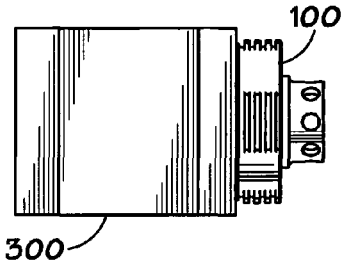
FIG. 7D
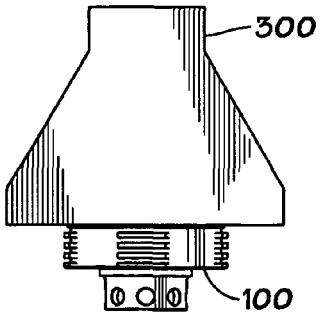
FIG. 7E
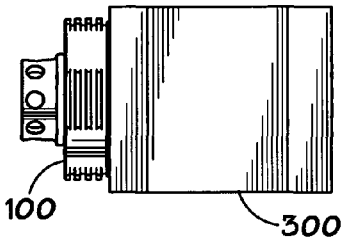
FIG. 7F
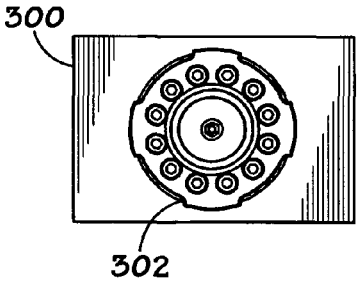
FIG. 7G
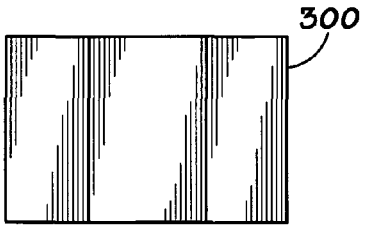
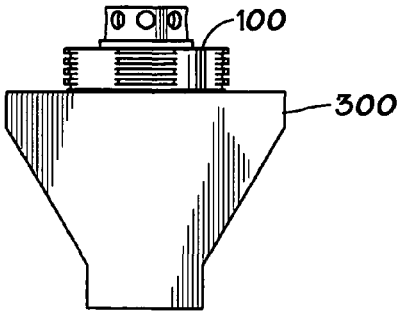
FIG. 7H FIG. 9C
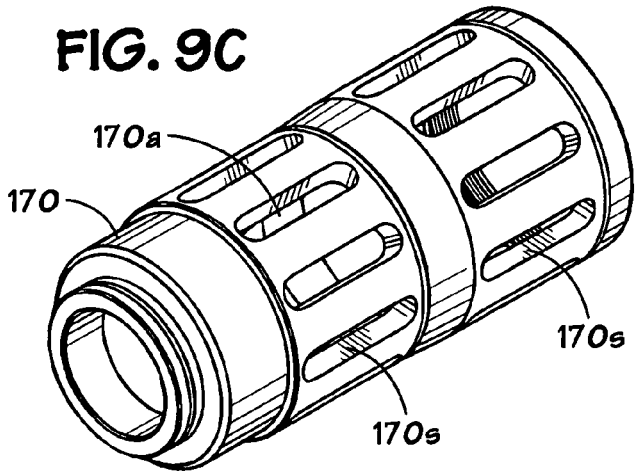
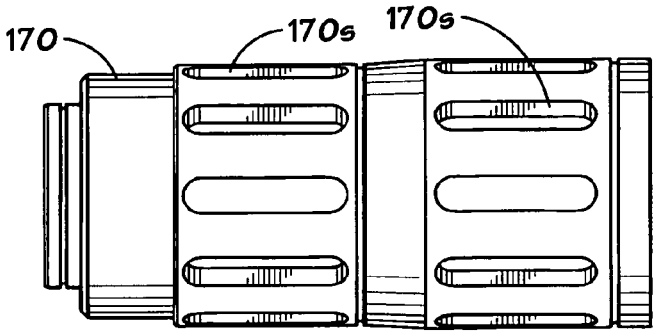
FIG. 9D
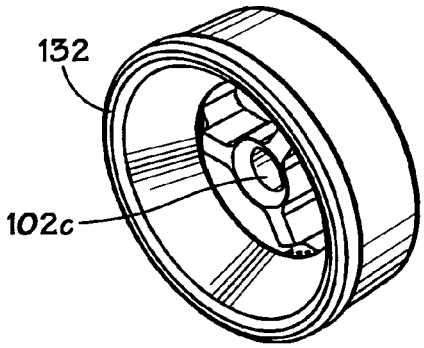
FIG. 9E
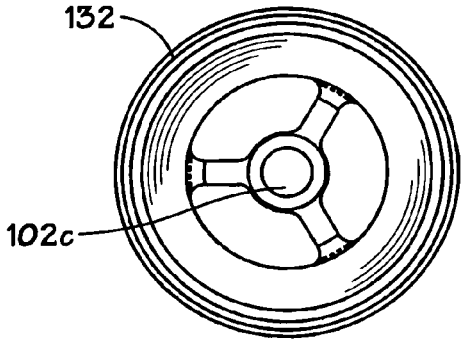
FIG. 9F
FIG. 9G
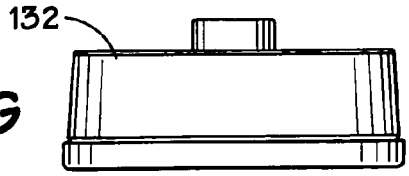

PISTON TRAVEL
19e
19
19m
19s
130
150
36
50
112
114
32
32a
141
10B
10C

PISTON TRAVEL
19e
19
19s
19m
36
50
130
100g
150
112
114
32
32a
141
11B
11C

FIG. 13A
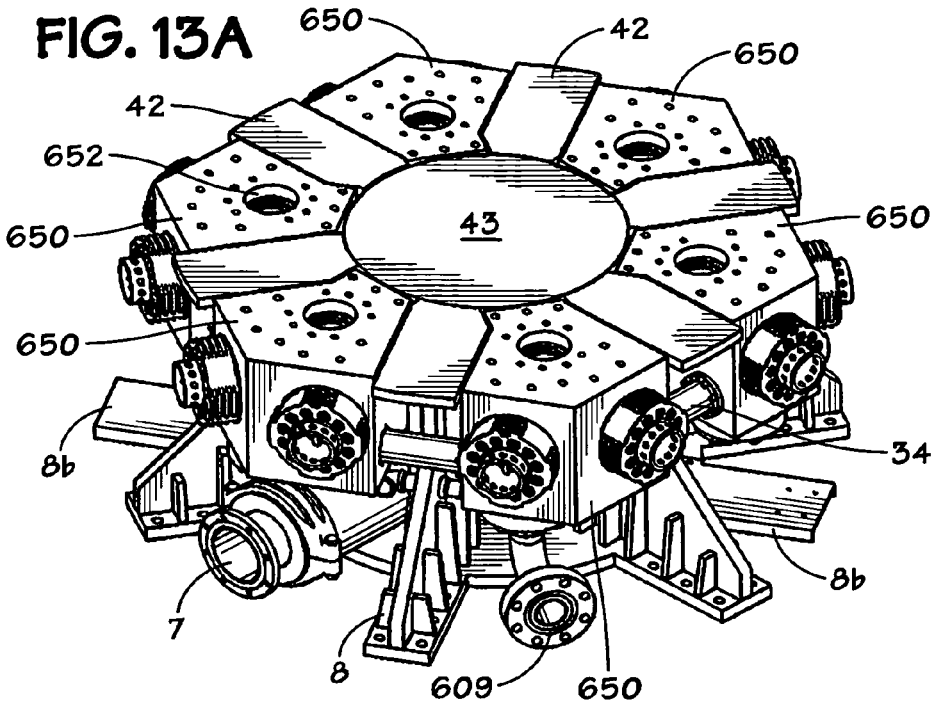
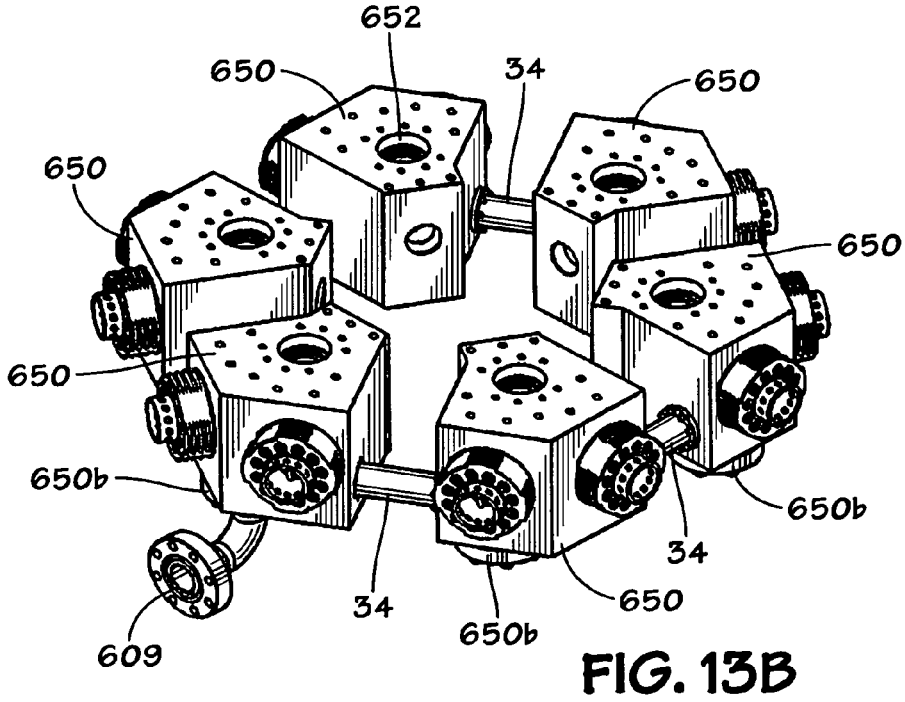
FIG. 13B 680
604
650
630

19
PISTON TRAVEL
18C
680
650
18C 650
18B
18B
680
630
19

19
PISTON TRAVEL
19B
19C
650
680
630
604
606

FIG. 21A
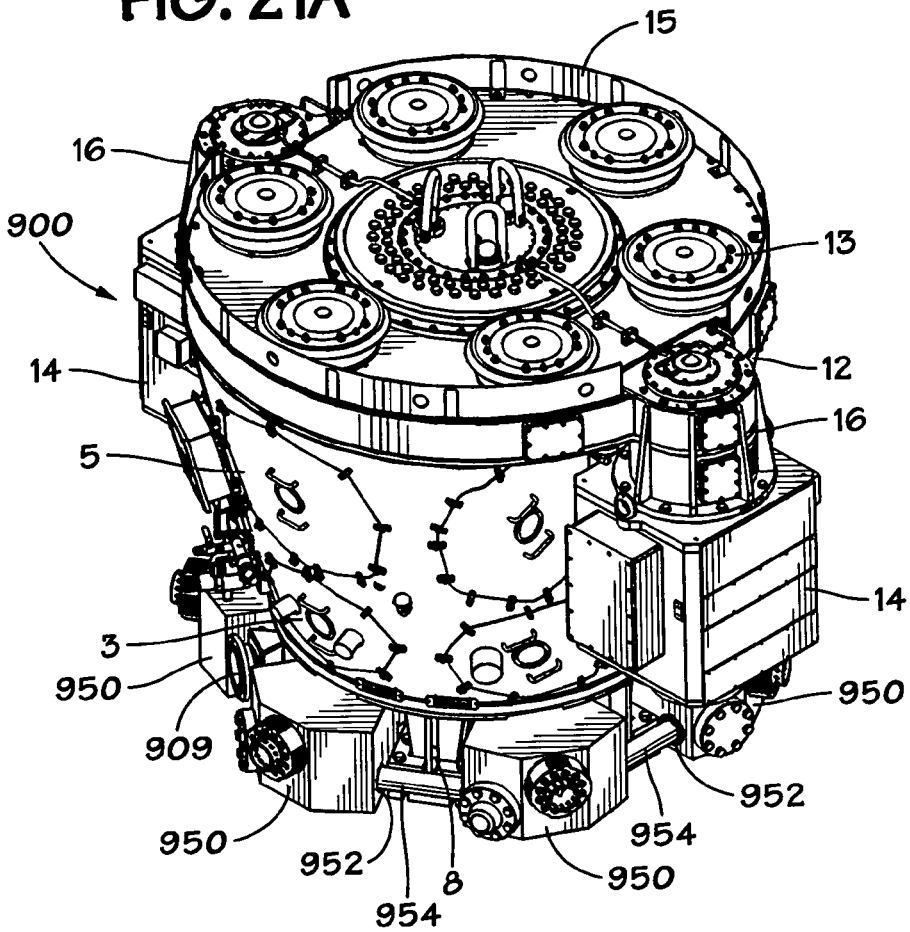
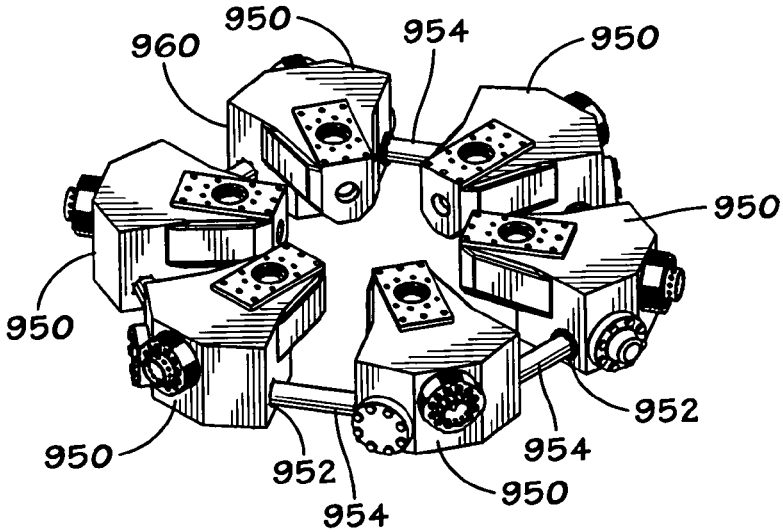
FIG. 21B

FIG. 21C
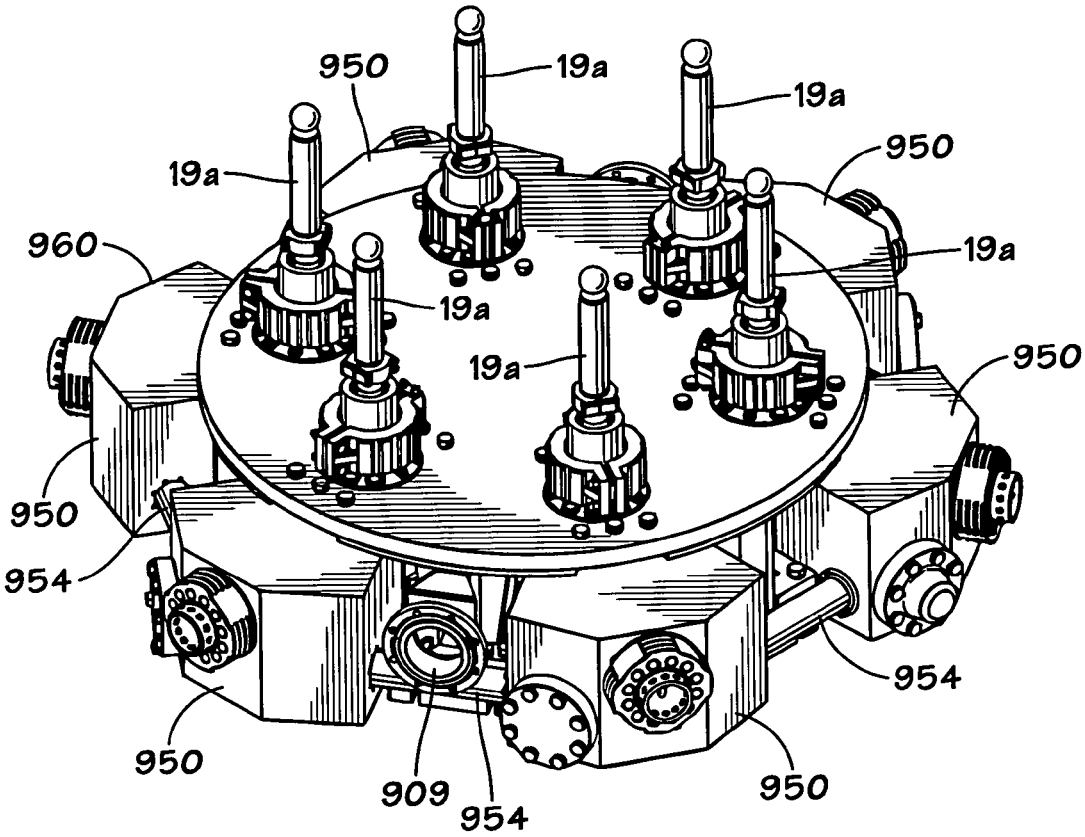
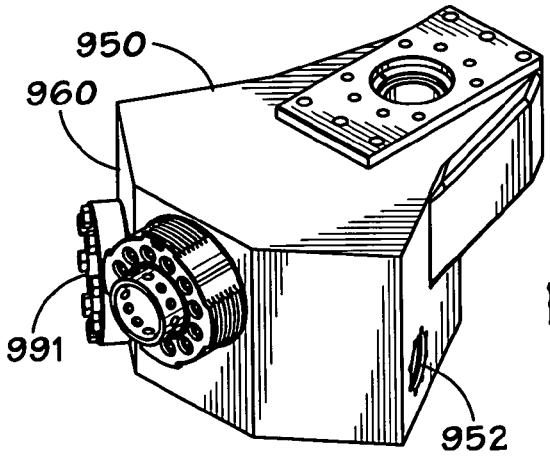
FIG. 21D

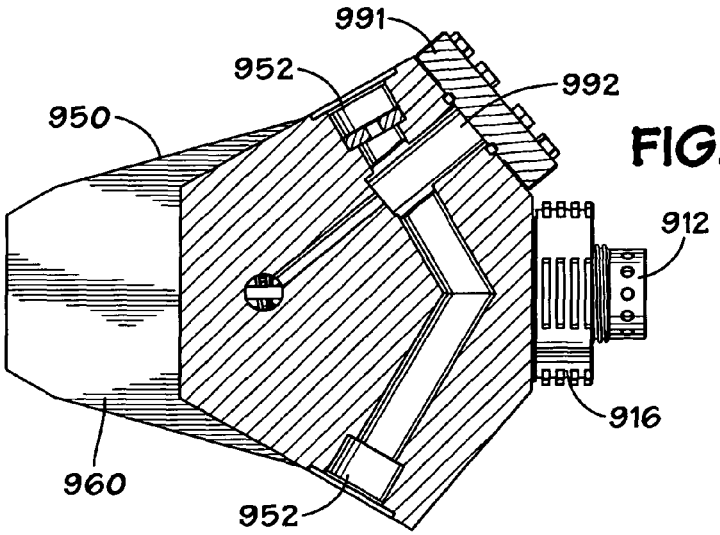
FIG. 21F
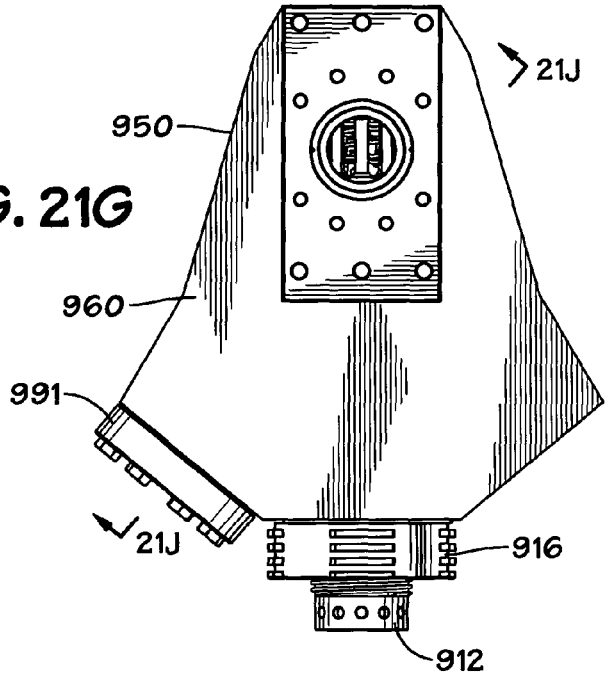
FIG. 21G
FIG. 21H
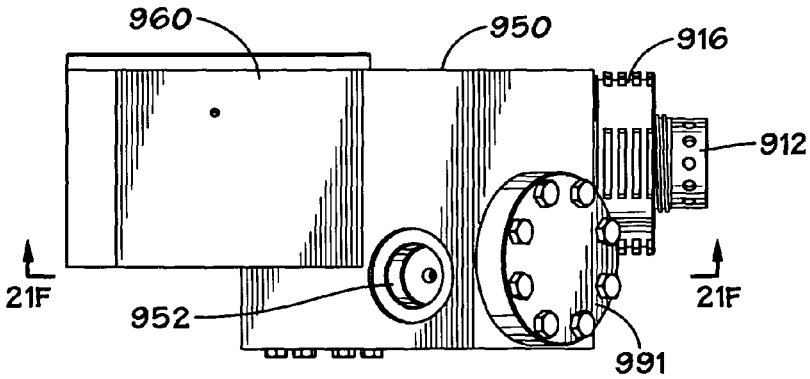

FIG. 21I
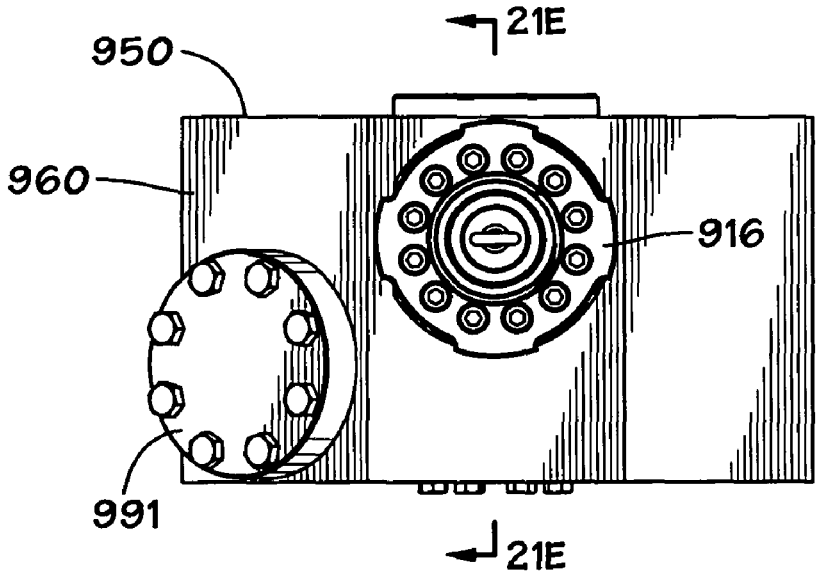
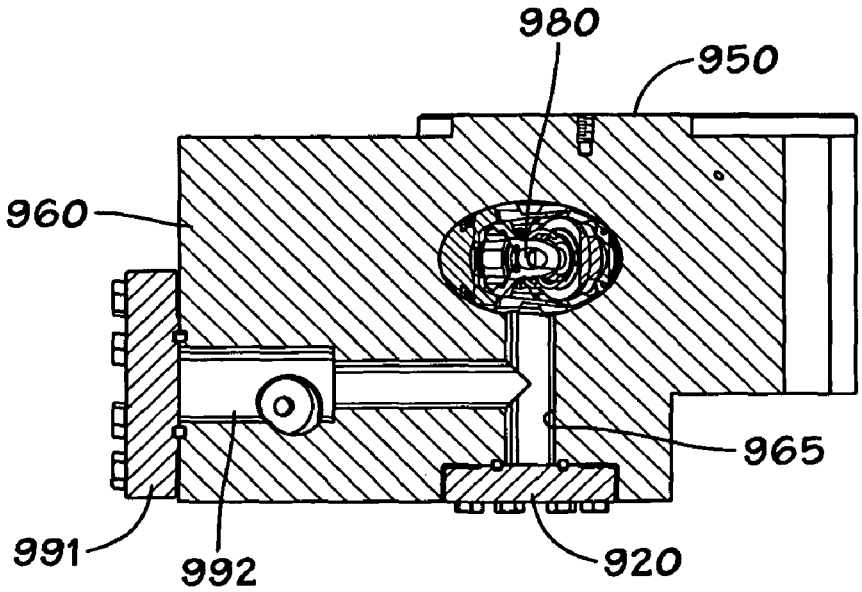
FIG. 21J

FIG. 22A
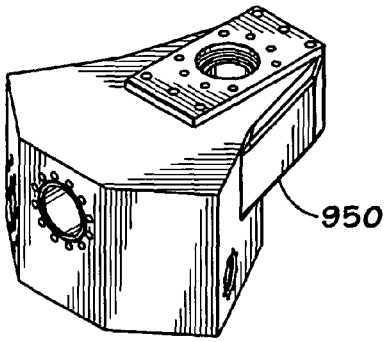
FIG. 22B
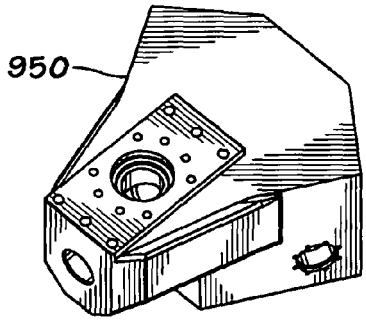
FIG. 22D
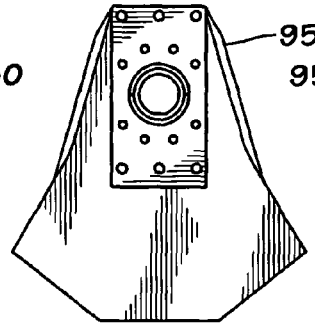
FIG. 22C
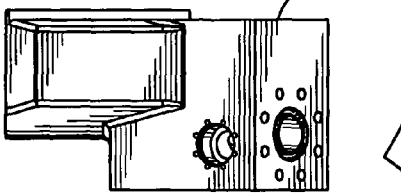
FIG. 22E
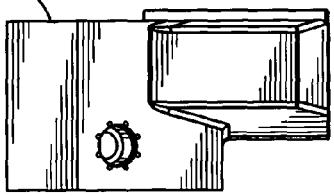
FIG. 22F
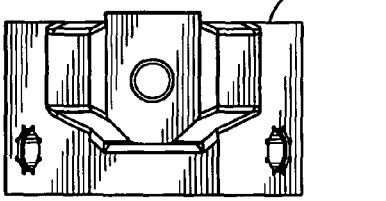
FIG. 22G
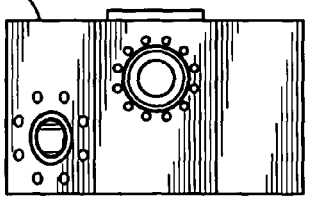
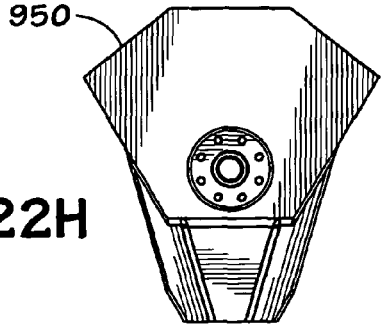
FIG. 22H FIG. 23A
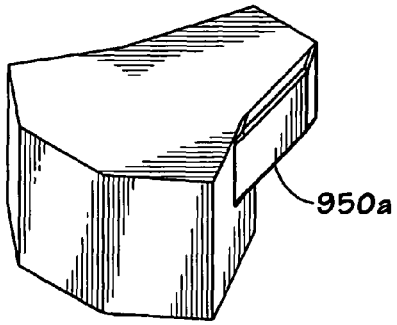
FIG. 23B
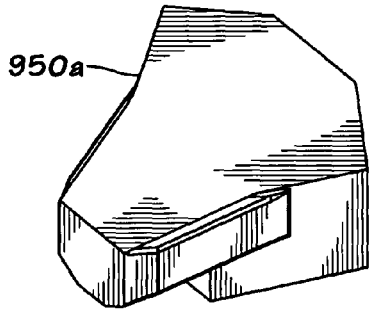
FIG. 23D
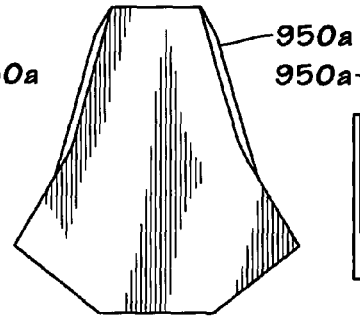
FIG. 23C
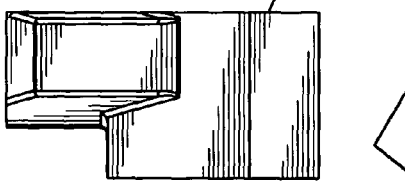
FIG. 23E
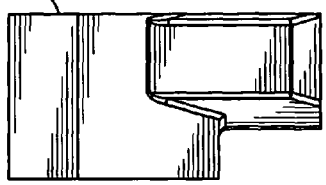
FIG. 23F
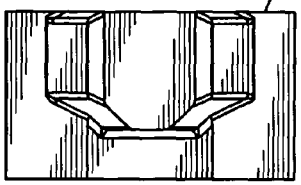
FIG. 23G
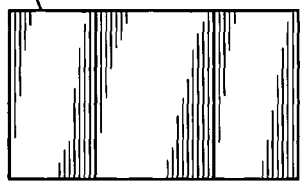
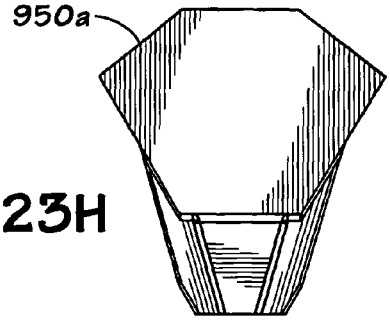
FIG. 23H FIG. 24H
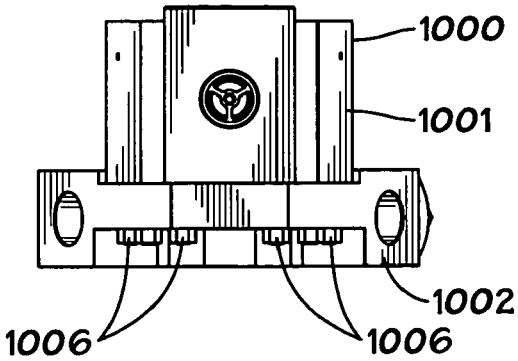
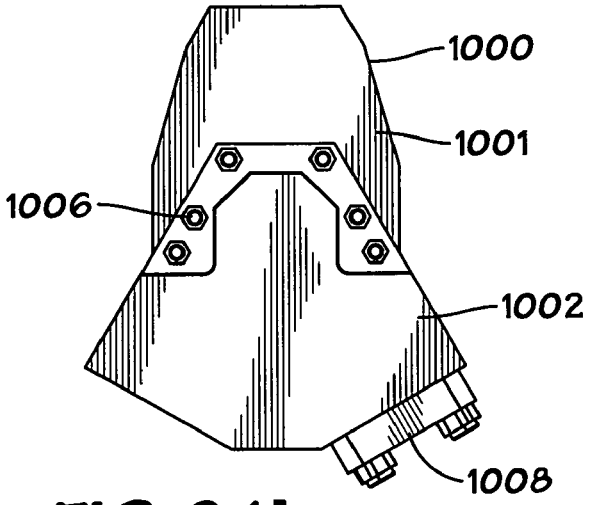
FIG. 24I
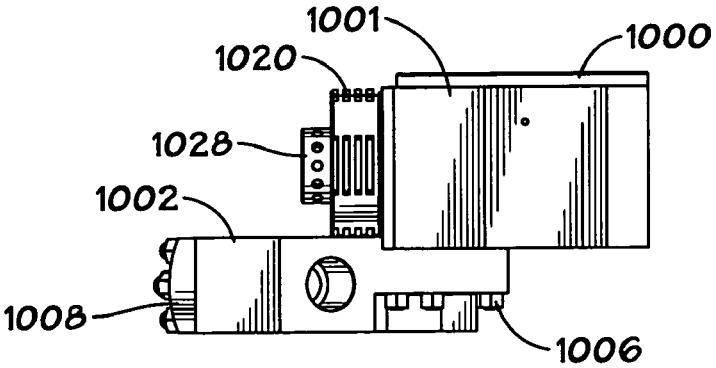
FIG. 24J

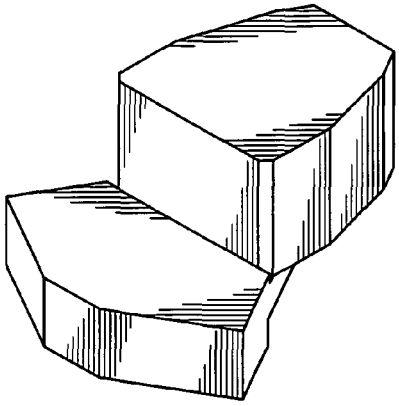
FIG. 25A
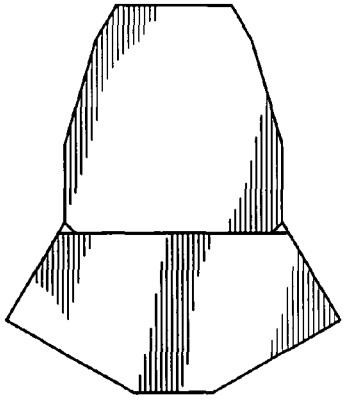
FIG. 24B
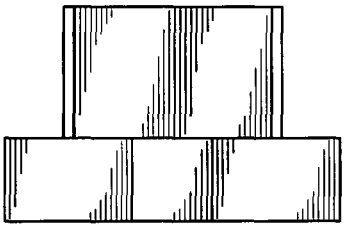
FIG. 25C
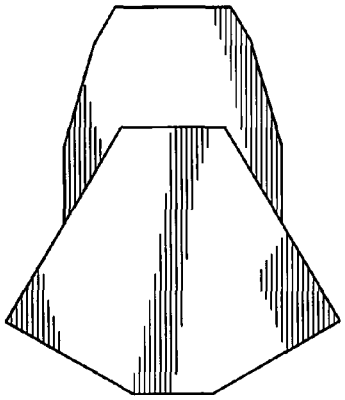
FIG. 25D
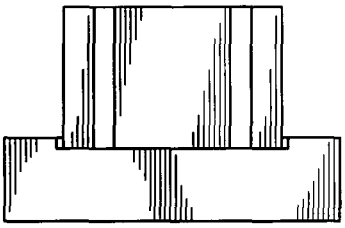
FIG. 25E
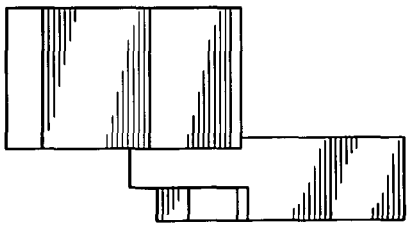
FIG. 25F
FIG. 25G
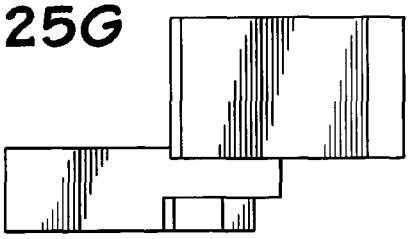

DRILLING FLUID PUMP SYSTEMS AND METHODS

BACKGROUND OF THE INVENTION

1. Field of the Invention

This present invention is directed to drilling wellbores in the earth, to systems for pumping drilling fluid ("mud") for such operations, to pump modules for such systems, and methods of their use.

2. Description of Related Art

The prior art discloses a wide variety of drilling systems, apparatuses, and methods including, but not limited to, the disclosures in U.S. Pat. Nos. 6,944,547; 6,918,453; 6,802,378; 6,050,348; 5,465,799; 4,995,465; 4,854,397; and 3,658,138, all incorporated fully herein for all purposes. The prior art discloses a wide variety of drilling fluid pumps ("mud pumps") used in drilling operations and pump systems; for example, and not by way of limitation, those pumps and systems disclosed in U.S. Pat. Nos. 6,257,354; 4,295,366; 4,527,959; 5,616,009; 4,242,057; 4,676,724; 5,823,093; 5,960,700; 5,059,101; 5,253,987; 6,718,955; and in U.S. application Ser. No. 10/833,921 filed Apr. 28, 2004 (all said U.S. references incorporated fully herein for all purposes).

By rotating a drill bit carried at an end of a drillstring wellbores are formed in the earth. Certain drillstrings include tubulars which may be drill pipe made of jointed sections or a continuous coiled tubing and a drilling assembly that has a drill bit at its bottom end. The drilling assembly is attached to the bottom end of the tubing or drillstring. In certain systems, to drill a wellbore, the drill bit is rotated by a downhole mud motor carried by the drilling assembly and/or by rotating the drill pipe (e.g. with a rotary system, power swivel, or with a top drive system). A drilling fluid, also referred to as "mud," is pumped under pressure from a pit or container at the surface by a pumping system at the surface.

Drilling fluid or mud can serve a variety of purposes. It can provide downhole hydrostatic pressure that is greater than the formation pressure to control the pressure of fluid in the earth formation being drilled and to avoid blow outs. The mud drives a downhole drilling motor (when used) and it also provides lubrication to various elements of the drill string. Commonly used drilling fluids are either water-based or oil-based fluids. They can also contain a variety of additives which provide desired viscosity, lubricating characteristics, heat, anti-corrosion and other performance characteristics.

During drilling, the mud that is pumped downhole by the mud pump system is discharged at the bottom of the drill bit and returns to the surface via the annular space between the tubulars of the drillstring and the wellbore inside (also referred to as the "annulus").

Certain prior, known mud pumps and mud pump systems have relatively complex and relatively heavy drive systems with typical connecting rods, eccentric shafts, and multiple rotating bearings, and many of these parts require constant lubrication. Certain prior "triplex" systems have a relatively large footprint.

Pending U.S. patent application Ser. No. 11/796,623 filed Apr. 27, 2007, co-owned with the present invention and incorporated fully herein for all purposes, discloses systems for pumping drilling fluid which include: a pump apparatus including a pumping section and a motor section; the pumping section having at least one pump, at least one inlet, and at least one outlet, and a main pinion shaft for operating the at least one pump; motor apparatus which is at least one AC motor; and the at least one AC motor directly connected to the main pinion shaft. In particular aspects, system for pumping drilling fluid are disclosed that include a pump apparatus including a pumping section and a motor section, the pumping section having at least one pump, at least one inlet, and at least one outlet, and a main pinion shaft for operating the at least one pump, motor apparatus comprising at least one AC motor, and the at least one AC motor directly connected to the main pinion shaft.

Pending U.S. patent application Ser. No. 11/414,163 filed Apr. 29, 2006, co-owned with the present invention and incorporated fully herein for all purposes, discloses drilling fluid pumping systems, also known as a mud pump systems, for pumping drilling fluid or mud used in wellbore operations in which a permanent magnet linear motor operates a pump apparatus to pump the fluid and the linear motor applies power directly. Such systems may have one, two-ten, or more mud pump apparatuses, each with a permanent magnet linear motor. In one aspect, a system is disclosed with pump apparatus with a pumping section and a motor section, the pumping section having an inlet and an outlet, the motor section having a shaft for reciprocating in and out of the pumping section to alternately suck fluid into the inlet and pump fluid out the outlet, and the motor being a permanent magnet linear motor for moving the shaft in a reciprocating motion, e.g., but not limited to, vertically or horizontally; and methods for using such a system.

FIG. 1 illustrates a prior art drilling fluid pump system S with internal pumping cylinders for pumping fluid through pump V with suction and discharge valves in a removable cartridge C. A service crane r with a pedestal P rotatably mounted on a bearing assembly B of the system S has a lift apparatus L movable on a beam E for lifting and moving system parts (e.g. pump modules, piston assemblies, roller forks). Motors T rotate pinion drives I to move a drive gear that in turn drives internal piston assemblies which drive the pumps V. In one particular aspect, the system S is a HEX 150 (Trademark) or a HEX 240 (Trademark) Pump System commercially available from National Oilwell Varco (owner of the present invention). The upper portion of the system S is like the upper portion of a system according to the present invention as shown in FIG. 3C.

The system S has a discharge ring D interconnected between and in communication with all the pump systems V. In some cases, such a discharge ring requires a relatively large space, has a relatively high weight and is relatively difficult to assemble. Also, due to internal flow direction changes, such a ring can shake during operation. In certain types of systems S, seats for the pump/valve system V are installed individually, e.g. press fit in place, and, therefore are destroyed when removed, e.g. as the result of an inspection of the inner valve. A cartridge C that has been removed is disassembled to inspect various parts, including the valve seats. In certain aspects in such prior systems expensive materials (e.g. S165M stainless steel) are used for parts and areas, e.g. standard known modules, which are subjected to high stress.

BRIEF SUMMARY OF THE INVENTION

The present invention discloses, in certain aspects, a drilling fluid pumping system, also known as a mud pump system, for pumping drilling fluid or mud used in wellbore operations.

In certain embodiments of modules in systems according to the present invention, the modules are made of relatively expensive material, e.g. S165M stainless steel e.g. with a thickness of about 2.36" (as has been done in the past with prior modules). In other aspects, modules according to the present invention are made with a relatively thicker wall thickness, e.g. at least 25% thicker, and, in certain aspects, 50% thicker, or more, e.g. also using relatively cheaper material, e.g. 8630M alloy steel. By using thicker-walled modules, deflection ("breathing") of the module wall near seal surfaces of the valve cartridge is reduced. Such deflection is the result of fluctuating internal pressure due to pump operation and can cause the premature failure of seals.

The present invention discloses, in certain aspects, a system for pumping drilling fluid, the system including a base; a plurality of pumping apparatuses connected to the base, including a first pumping apparatus, each pumping apparatus including a pumping module with a module body; pumping structure for pumping fluid to and from each module; a conduit apparatus between each pair of adjacent modules so that fluid discharged from each module is flowable to the first pumping apparatus and into the module of the first pumping apparatus for discharge; and a main outlet for receiving fluid pumped by all the pumping apparatuses. Such a system may be used to pump drilling fluid through a wellbore in the earth (as may any system according to the present invention be used). Also, any system described herein according to the present invention for pumping fluid through a wellbore may be used to pump drilling fluid above the earth.

It is, therefore, an object of at least certain preferred embodiments of the present invention to provide new, useful, unique, efficient, nonobvious drilling fluid pumping systems, methods of their use, drilling systems and methods, and mud pump systems for use in drilling operations.

Accordingly, the present invention includes features and advantages which are believed to enable it to advance drilling fluid pumping technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide new, useful, unique, efficient, nonobvious fluid pumping systems, methods of their use, drilling systems and methods, and mud pump systems for use in drilling operations.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 4A is a perspective view of part of the system of FIG. 3A.

FIG. 4B is a perspective view of a portion of the part of the system as shown in FIG. 4A.

FIG. 4C is a perspective view of a portion of the part of the system as shown in FIG. 4A.

FIG. 4D is a partial cross-section view of the system of FIG. 3A.

FIG. 5 is a perspective view of part of the system of FIG. 3A.

FIG. 6A is a front top perspective view of a module of the system of FIG. 3A.

FIG. 6B is a rear top perspective view of the module of FIG. 6A.

FIG. 6C is a right (as viewed in FIG. 6A) side view of the module of FIG. 6A.

FIG. 6D is a top view of the module of FIG. 6A.

FIG. 6E is left (as viewed in FIG. 6A) side view of the module of FIG. 6A.

FIG. 6F is a front view of the module of FIG. 6A.

FIG. 6G is a front view of the module of FIG. 6A.

FIG. 6H is a front view of the module of FIG. 6A.

FIG. 7A is a front top perspective view of a module of the system of FIG. 3A.

FIG. 7B is a rear top perspective view of the module of FIG. 7A.

FIG. 7C is a left (as viewed in FIG. 7A) side view of the module of FIG. 7A.

FIG. 7D is a top view of the module of FIG. 7A.

FIG. 7E is a right (as viewed in FIG. 7A) side view of the module of FIG. 7A.

FIG. 7F is a front view of the module of FIG. 7A.

FIG. 7G is a front view of the module of FIG. 7A.

FIG. 7H is a front view of the module of FIG. 7A.

FIG. 9C is a perspective view of a sleeve of the module of FIG. 9A.

FIG. 9D is a side view of the sleeve of FIG. 9C.

FIG. 9E is a perspective view of a valve seat of the module of FIG. 9A.

FIG. 9F is a rear view of a valve seat of the module of FIG. 9E.

FIG. 9G is a side view of a valve seat of the module of FIG. 9E.

FIG. 13A is a perspective view of part of the system of FIG. 12A.

FIG. 13B is a perspective view of a portion of the part of the system as shown in FIG. 12A.

FIG. 21A is a perspective view of a system according to the present invention.

FIG. 21B is a perspective view of a portion of the part of the system as shown in FIG. 21A.

FIG. 21C is a top perspective view of part of the system of FIG. 21A.

FIG. 21D is a perspective view of a module of the system of FIG. 21A.

FIG. 21F is a cross-section view along line F-F of FIG. 21H.

FIG. 21G is a top view of the module of FIG. 21D.

FIG. 21H is a side view of the module of FIG. 21D.

FIG. 21I is a front view of the module of FIG. 21D.

FIG. 21J is a cross-section view along line J-J of FIG. 21G.

FIG. 22A is a front top perspective view of a module according to the present invention.

FIG. 22B is a rear top perspective view of the module of FIG. 22A.

FIG. 22C is a left (as viewed in FIG. 22A) side view of the module of FIG. 22A.

FIG. 22D is a top view of the module of FIG. 22A.

FIG. 22E is a right (as viewed in FIG. 22A) side view of the module of FIG. 22A.

FIG. 22F is a front view of the module of FIG. 22A.

FIG. 22G is a front view of the module of FIG. 22A.

FIG. 22H is a front view of the module of FIG. 22A.

FIG. 23A is a front top perspective view of a module according to the present invention.

FIG. 23B is a rear top perspective view of the module of FIG. 23A.

FIG. 23C is a left (as viewed in FIG. 23A) side view of the module of FIG. 23A.

FIG. 23D is a top view of the module of FIG. 23A.

FIG. 23E is a right (as viewed in FIG. 23A) side view of the module of FIG. 23A.

FIG. 23F is a front view of the module of FIG. 23A.

FIG. 23G is a front view of the module of FIG. 23A.

FIG. 23H is a front view of the module of FIG. 23A.

FIG. 24G is a bottom cross-section view of the module of FIG. 24A along line G-G of FIG. 24F.

FIG. 24H is a rear view of the module of FIG. 24A.

FIG. 24I is a top view of the module of FIG. 24A.

FIG. 24J is a side view (opposite the side of FIG. 24F) of the module of FIG. 24A.

FIG. 25A is a front top perspective view of a module body according to the present invention.

FIG. 25B is a top perspective view of the module body of FIG. 25A.

FIG. 25C is a front view of the module body of FIG. 25A.

FIG. 25D is a bottom view of the module body of FIG. 16A.

FIG. 25E is a rear view of the module body of FIG. 25A.

FIG. 25F is a side view of the module body of FIG. 25A.

FIG. 25G is a side view of the module body of FIG. 25A (opposite the side of FIG. 25F).

Figure 1:
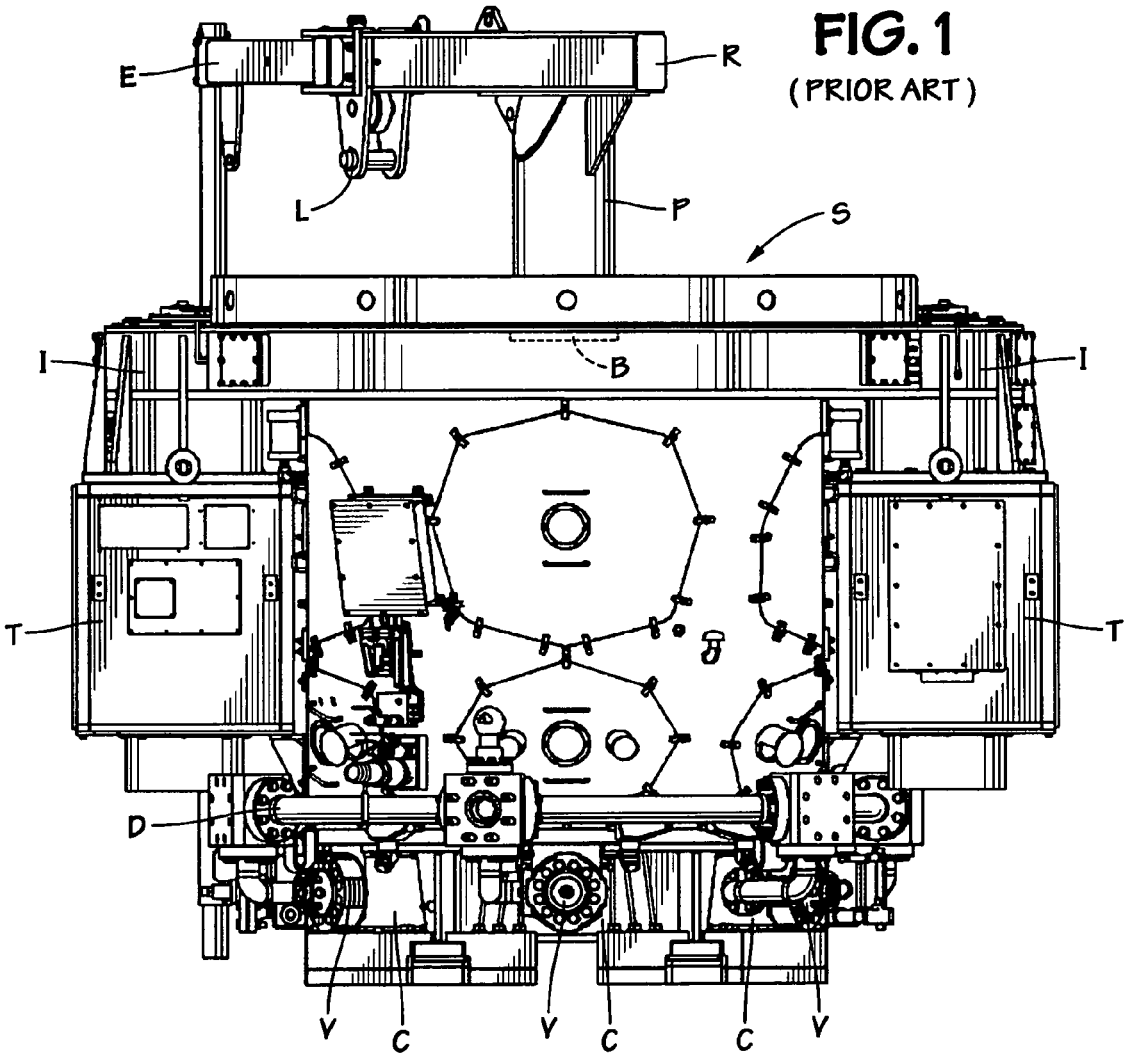
FIG. 1 (PRIOR ART)
FIG. 1 is a front view of a prior art pumping system.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 2:
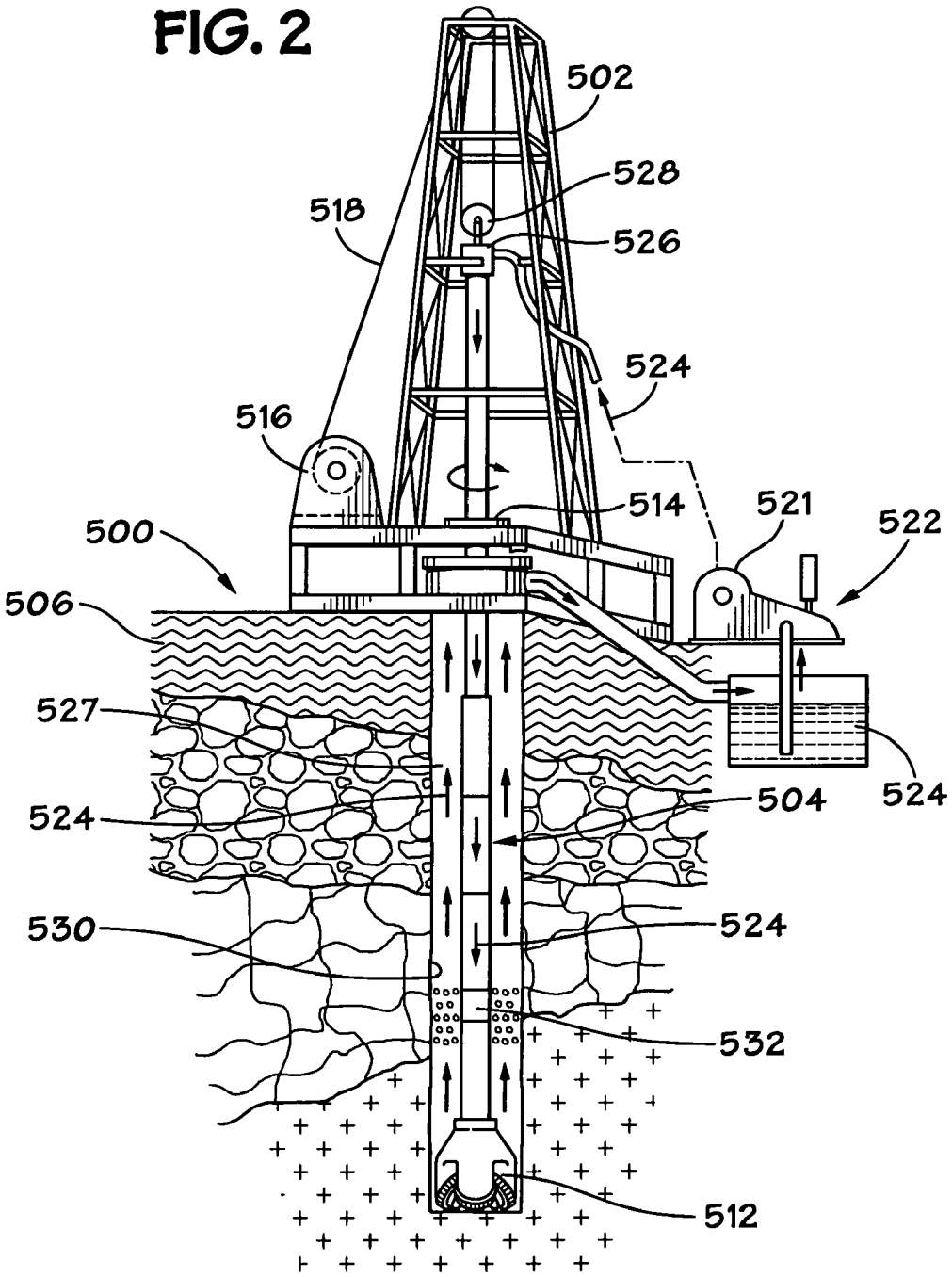
FIG. 2 is a schematic view, partially cutaway, of a system according to the present invention.

The system 500 shown in FIG. 2 includes a derrick 502 from which extends a drillstring 504 into the earth 506. The drillstring 504, as is well known, can include drill pipes and drill collars. A drill bit 512 is at the end of the drillstring. A rotary system 514, top drive system 526, and/or a downhole motor 532 ("fluid motor", "mud motor") may be used to rotate the drillstring 504 and the drill bit 512. A typical draw-works 516 has a cable or rope apparatus 518 for supporting items in the derrick 502. A system 522 with one, two, or more mud pump systems 521 according to the present invention supplies drilling fluid 524 to the drillstring 504. Drilling forms a wellbore 530 extending down into the earth 506.

During drilling, the drilling fluid 524 is pumped by pump(s) 521 of the system 522 into the drillstring 504 (thereby operating a downhole motor 532 if such an optional motor is used). Drilling fluid 524 flows to the drill bit 512, and then flows into the wellbore 530 through passages in the drill bit 512. Circulation of the drilling fluid 524 transports earth and/or rock cuttings, debris, etc. from the bottom of the wellbore 530 to the surface through an annulus 527 between a well wall of the wellbore 530 and the drillstring 504. The cuttings are removed from the drilling fluid 524 so that it may be re-circulated from a mud pit or container 528 by the pump(s) of the system 522 back to the drillstring 506.

Figure 3B:
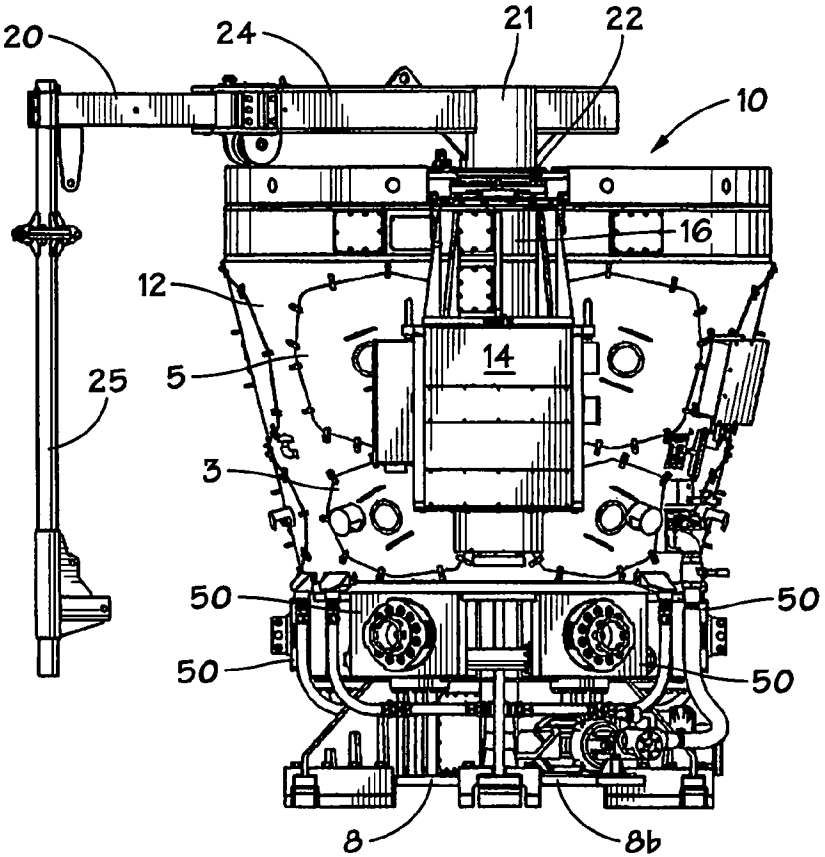
FIG. 3B is a side view of the system of FIG. 3A.
Figure 3A:
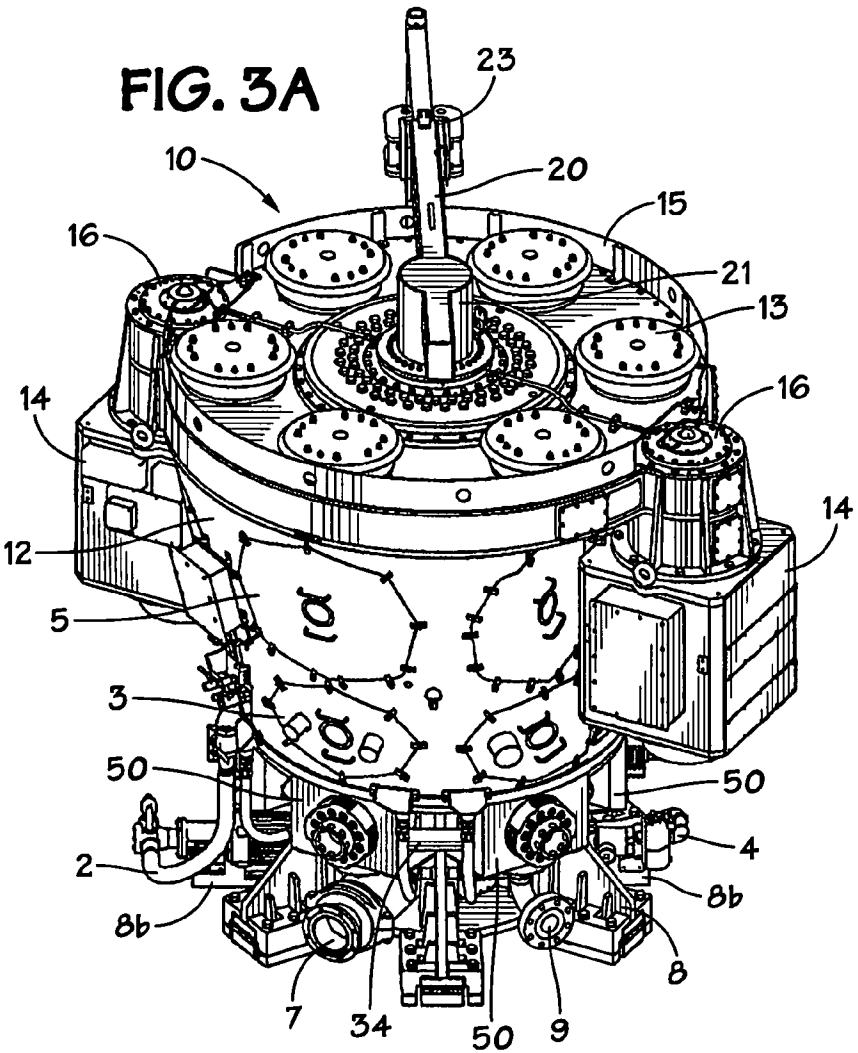
FIG. 3A is a perspective view of a system according to the present invention.

A system 10 according to the present invention as shown in FIGS. 3A and 3B has a main housing 12 mounted on a base 8 with an optional crane system 20 for lifting and moving system parts. A pedestal 21 of the crane system 20 is rotatably mounted on a bearing assembly 22 on the housing 12. A lift apparatus 23 is movably mounted on a beam 24 and a support 25 extends down from the lift apparatus 23. A chain hoist lift may be used with the structure shown which is attached to the support 25. Motors 14 each drive pinions 16 which in turn drive a drive gear 18 (see FIG. 3C) to move pistons 19 for six removable pump modules 50 (as described below). A pressure relief apparatus (e.g. one or more relief valves) is provided for the modules 50 and, as shown, in one aspect, for each of the six modules 50 there is a pressure relief valve 13. Optional rails 15 project up from the housing 12.

An oil pump 2 pumps lubricating oil to various parts of the system. A water pump 4 pumps water to a filtration system (not shown) and a cooler (not shown). The pumps are mounted on pump mounts 8*b* connected to the base 8. Doors 3 and 5 (one each for each pump system 30) provide access to various internal parts of the system 10. Drilling fluid enters the system 10 through an inlet 7 and is pumped out via the modules 50 to a main outlet 9.

Figure 3C:
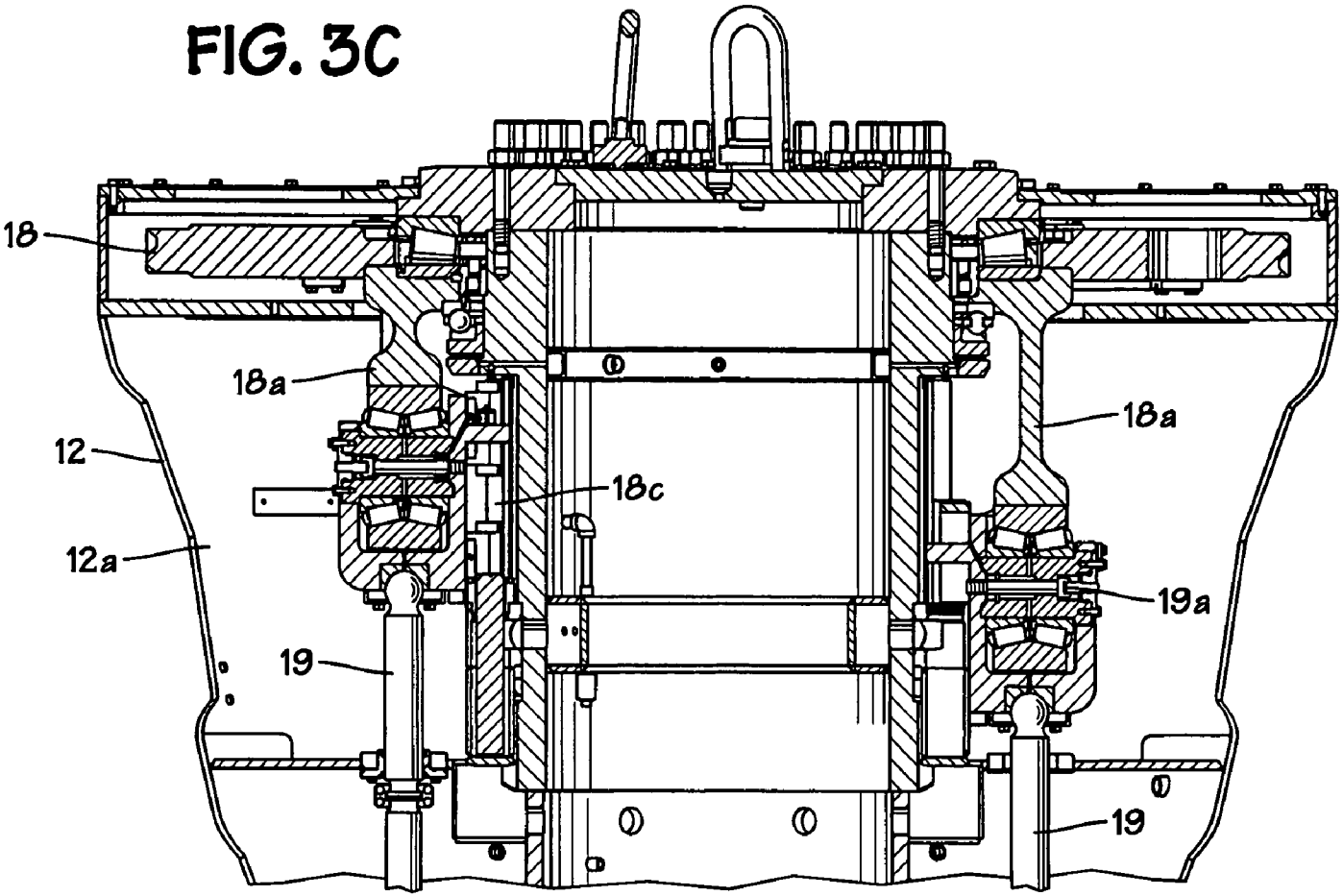
FIG. 3C is a partial cross-section view of the system of FIG. 3A.

FIG. 3C shows the drive gear 18 with profiled cam structures 18*a* (driven by the pinions 16, FIG. 3A) which are cammed to sequentially move pump drive pistons 19 up and down sequentially in the modules 50 for pumping fluid. Each piston rod 19 is connected to a translation assembly 19*a*. The hydraulic lift cylinders 18*c* provide a constant force to maintain contact with the cam structures 18*a* and the assemblies 19*a*. The oil pump 2 pumps lubricating oil into an interior space 12*a* of the housing 12 to lubricate parts therein. Each piston 19 includes (e.g. see FIG. 10B) an extension rod 19*e*, a piston seal 19*s*, and a piston member 19*m* (often referred to as "the piston").

Figure 3D:
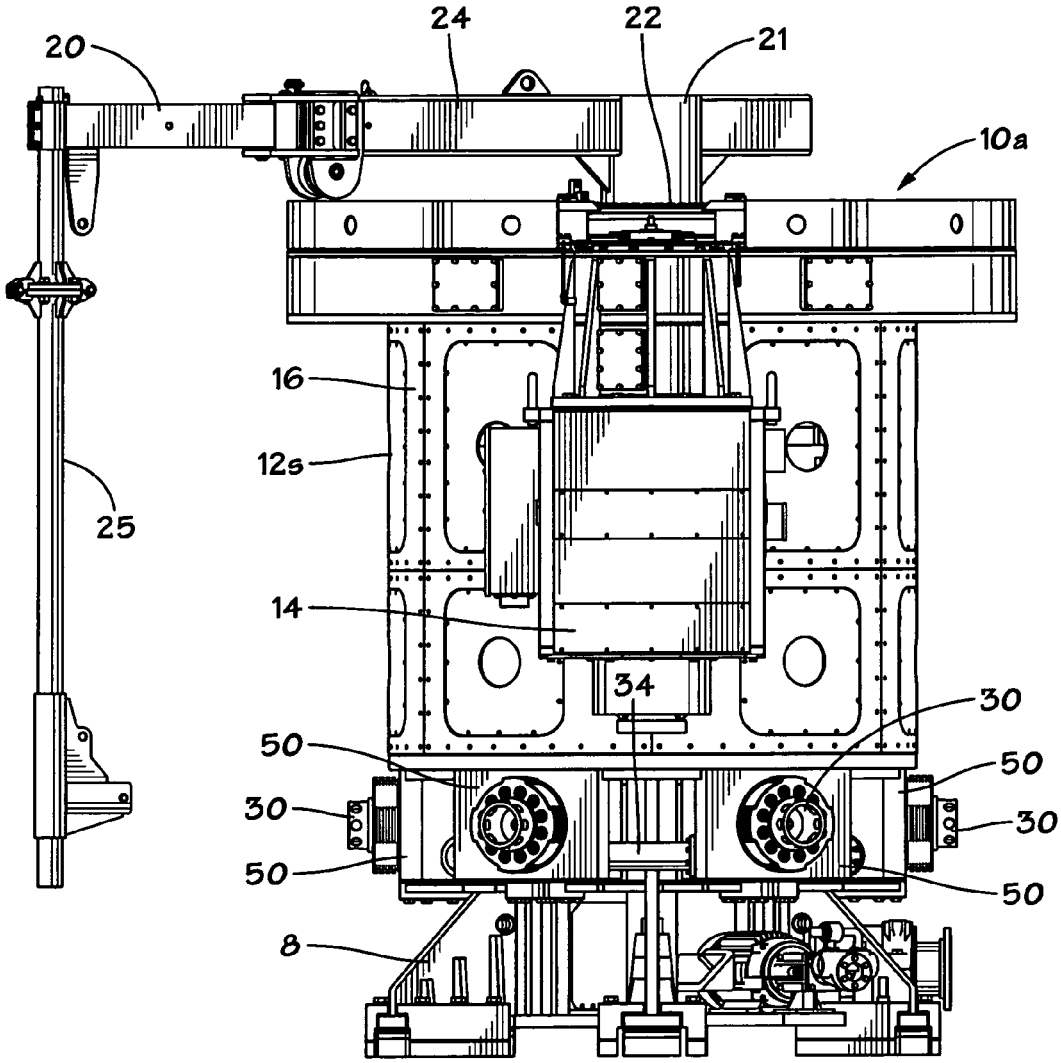
FIG. 3D is a side view of a system according to the present invention.
Figure 8A:
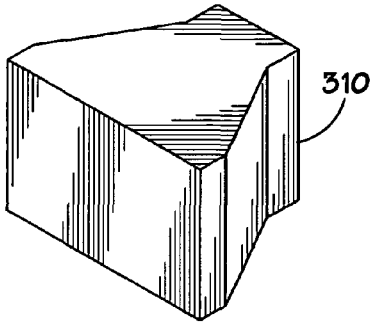
FIG. 8A is a front top perspective view of a module body according to the present invention.
Figure 8B:
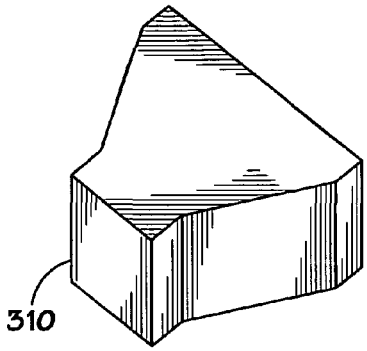
FIG. 8B is a rear top perspective view of the module body of FIG. 8A.
Figure 8C:
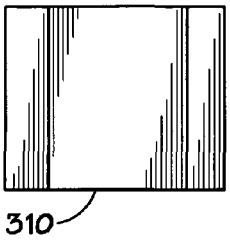
FIG. 8C is a left (as viewed in FIG. 8A) side view of the module body of FIG. 8A.
Figure 8D:
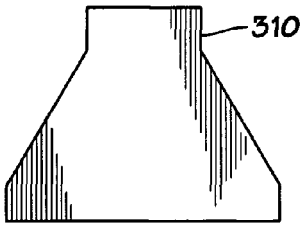
FIG. 8D is a top view of the module body of FIG. 8A.
Figure 8E:
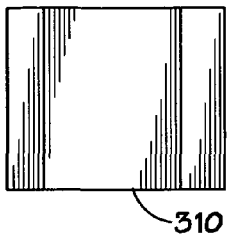
FIG. 8E is a right (as viewed in FIG. 8A) side view of the module body of FIG. 8A.
Figure 8F:
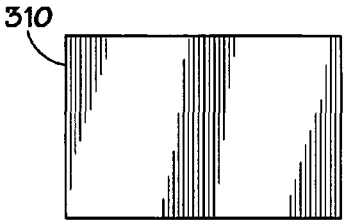
FIG. 8F is a front view of the module body of FIG. 8A.
Figure 8G:
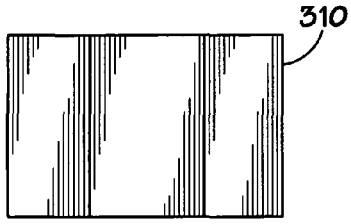
FIG. 8G is a front view of the module body of FIG. 8A.
Figure 8H:
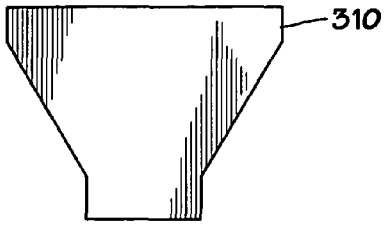
FIG. 8H is a front view of the module body of FIG. 8A.

FIG. 3D illustrates a system 10*a*; like the system 10 (like numerals indicate like parts) which has a housing 12*s* which is not tapered or conical as is the housing 12, FIG. 3A, but rather is generally cylindrical (less complex than some other shapes and relatively easy to manufacture) and, which provides increased strength and rigidity.

FIGS. 4A and 4B show a holding structure 40 holding six pump modules 50 according to the present invention each with a valve assembly 100 removably disposed therein. Each module 50 fits between two arms 42 and rests on a shelf 44 of the holding structure 40. The shelves 44 are connected to the base 8 and the arms 42 are centered around a center portion 43 and are connected to projections 8*a* of the base 8. Fluid enters the modules 50 through inlets 62 of a central channel member 60, flows into inlets 36 of each module 50, and is pumped from each module 50 in a discharge outlet 32 (described below), into a discharge line 34, and then to the main outlet 9. An intersection 32*a* of the two flow channels, 32 and 34, is shown, e.g. in FIG. 11B. Each module 50 has an opening or chamber 52 down into which projects a drive piston 19. Fluid is moved into a pump module 50 when the piston 19 moves up and is moved to the discharge outlet 32 when the piston 19 moves down. The channel member 60 includes a bowl 67 with a lower entry port 67*a*. Use of an entry port below the inlets 62 reduces or eliminates the settling of solids on the bottom of the bowl 67. Blind flanges 32*f* close off lower bores of the modules.

Optionally, a suction dampener 66 can be used at the inlet 7 to absorb shock waves in incoming fluid. In one aspect the suction dampener 66, which has a generally cylindrical hollow shape lining an enlarged portion 7*a* of the inlet 7, is made from a compressible material such as sponge or compressible closed cell foam. In certain aspects, fluid entering the inlet 7 at a pressure of, e.g., 50 psi can have pressure fluctuations or spikes, e.g. up to 150 psi. The suction dampener 66 absorbs some or substantially all of these pressure spikes to reduce or eliminate cavitation and so that a fluid at substantially constant pressure flows to an inlet portion 76 and to the inlets 62.

FIGS. 6A-6H show a module 50 with a valve assembly 100. Discharge pipes 34 connect to openings 34*a*, 34*b*, on each module 50. The discharge pipes 34 provide a common discharge conduit for the drilling fluid via channels in the modules and this allows the discharge outlet to be located on any of the modules.

FIGS. 7A-7H illustrate a module 300 according to the present invention, like the module 50, with no side or top openings other than an opening 302 of an interior channel for a valve assembly 100. Side and top openings, are to be added as needed.

FIGS. 8A-8H show a design for a module body 310 according to the present invention for use as a module in fluid pumping systems.

Figure 9A:
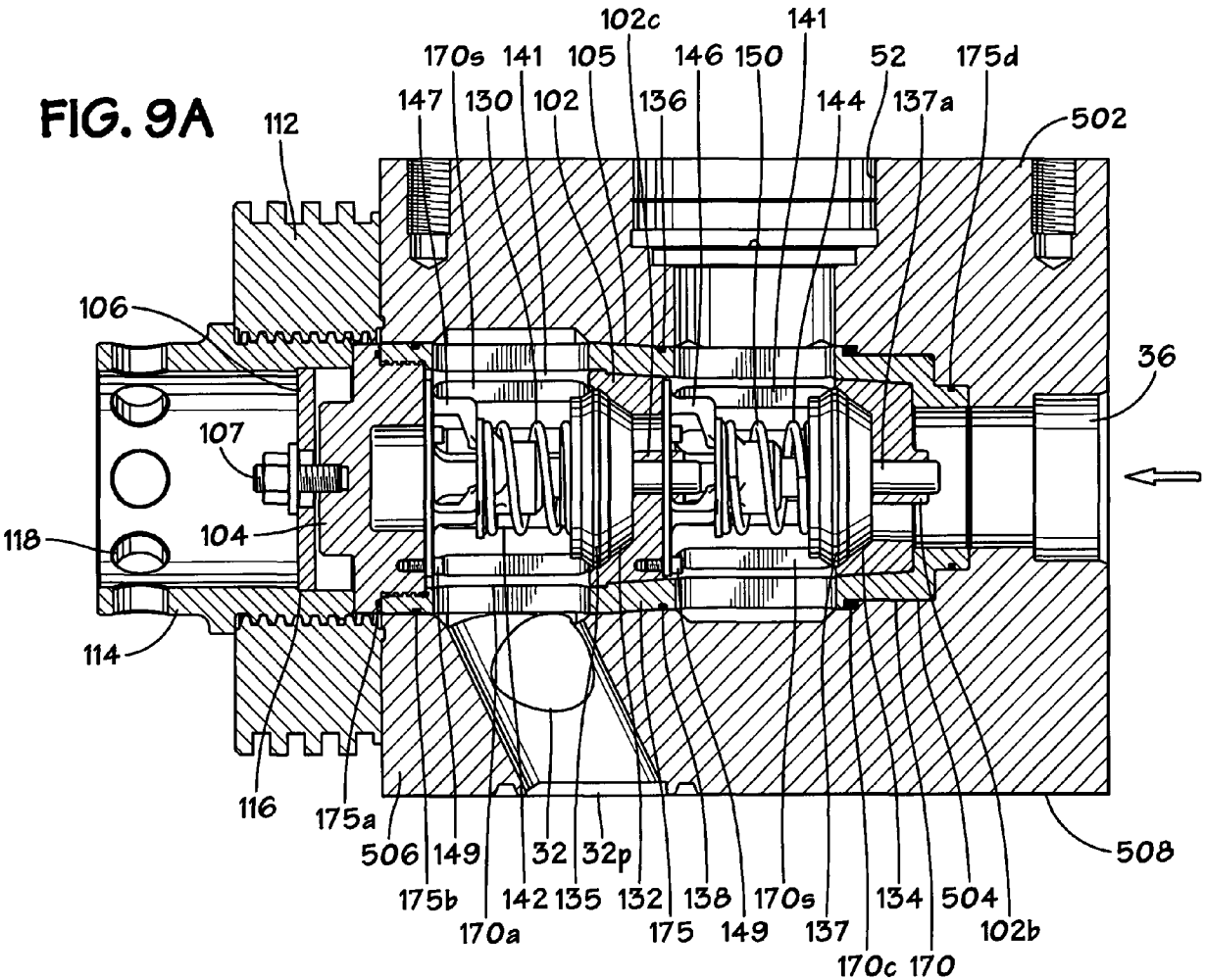
FIG. 9A is a cross-section view of a module according to the present invention of the system of FIG. 3A.
Figure 9B:
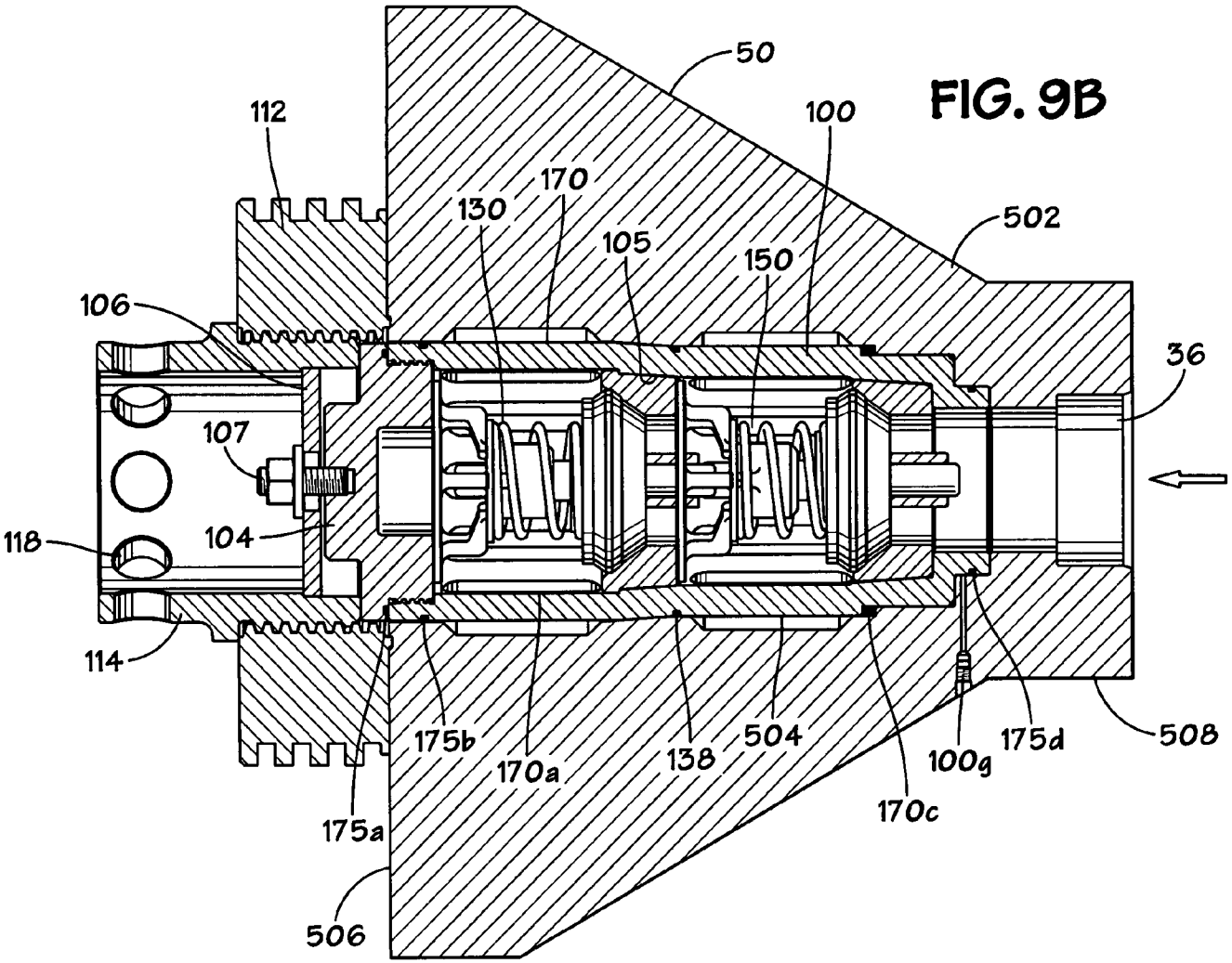
FIG. 9B is a cross-section view of a module according to the present invention of the system of FIG. 3A.

FIGS. 9A and 9B illustrate inner parts of a valve assembly 100. Drilling fluid or mud is forced to the discharge outlet 32 when the piston 19 moves downward. Each piston 19 moves mud to the discharge outlet 32 in the same way. The mud then travels to the main outlet (e.g. outlet 9, FIG. 4A). The main outlet can be on any of the modules. A blind flange is bolted over an opening 32*p* of each modules which is not chosen as a location for the main outlet. The location of the main outlet is chosen during installation to ease installation of the pump. The main outlet is designed so that the pressure generated force acting at both ends of the outlet equal in magnitude and opposite in direction so that the net unbalanced force is zero. This is advantageous because the components of a discharge conduit do not have to be designed to prevent the pressure force from separating the conduit from the module. The result is a module that is lighter, less costly and easier to assemble. Also, in certain aspects, structures according to the present invention eliminate O-ring seals used in certain existing designs to attempt to help with the alignment of a discharge ring and modules. Each module has a discharge outlet. Any discharge outlet can be chosen as the main outlet. The other discharge outlets are secured with a blind flange.

The valve assembly 100 is within a module 50 that has a body 502 with a multi-part bore 504 therethrough from an exterior end 506 of the body 502 to an interior end 508. The valve assembly 100 has a cap 104 whose exterior threads threadedly mate with interior threads of a sleeve 170 with slots 170*s* in the valve body 102. A plate 106 is bolted with a bolt 107 to the cap 104. A tool (not shown; e.g. an hydraulic tool) pushing against the plate forces the body 102 into the bore 504. This makes it possible to remove the bolt 107 and thread an adapter into the cap 104 and pull the entire valve assembly (seats, valves, sleeve and all) out of the housing. Additionally, a grease port 100*g* (see FIG. 11C) that is positioned at the suction end of the sleeve allow a grease gun to be attached to the grease zerk at the grease port. The grease exerts a pressure on the back side of the sleeve which dislodges the sleeve from the housing, making it easier to remove the entire valve assembly. Thus, in one aspect, a valve assembly according to the present invention can be built ahead of time (e.g. at a remote site and/or on a rig, e.g. in a tool room) and therefore quickly change the valve assembly when it becomes necessary.

A lug ring 112 connected to the body 102 has interior threading that threadedly mates with exterior threading on an end nut 114. The end nut 114 holds the cap 104 and the body 102 in position in the bore 104. The plate 106 abuts a shoulder 116 of the end nut 114. Holes 118 in the end nut 114 facilitate its rotation.

The valve assembly 100 includes a discharge valve 130 and a suction valve 150. The discharge valve 130 has a valve member 135 that seats against a seat 132 in the bore 101 of the valve body 102 and the valve 150 has a valve member 137 that seats against a seat 134 in the bore 101 of the valve body 102.

The valve body 102 is slightly tapered (see, e.g. FIGS. 9A and 9C) and, in one aspect, the taper is on a section radially outboard of a discharge seat, e.g. about half way down the length of the sleeve OD; e.g. from a first diameter at the end with the cap 104 to a second smaller diameter at the end with the discharge valve 130. In one aspect, the sleeve taper is radially outboard of the discharge valve seat taper. A bore 170*a* of the sleeve 170 has a corresponding taper. The bore 504 of the module body 502 also has a corresponding taper. An O-ring seal 175*e* is on the OD of the sleeve 170 and the body 102 has the portion 105 which sealingly abuts the seal surface 175 to provide a primary seal (sealed preventing fluid in the discharge chamber from leaking back around the discharge valve and into the pump chamber when the piston is on the suction stroke). In one aspect the taper on the OD of the sleeve 170 provides a robust seal between a pump chamber (e.g. chamber 52, FIG. 4D) and a discharge chamber. This taper is a primary seal and seals against the O-ring 175.

An O-ring 136 in a recess 138 in the body 102 sealingly abuts the seal surface 175 providing an optional secondary seal. A guide shaft 137*a* connected to the valve member 137 moves in a corresponding guide channel 102*b* in the body 102. A guide shaft 130*a* connected to the valve member 130 moves in a corresponding guide channel 102*c* in the body 102. The OD of the sleeve 170 is cylindrical except for the section radially outboard of portion 105; and the ID of the sleeve 170 is cylindrical except for the two tapers that accept the valve seats. Seals 175*a*-175*f* provide seals at their locations.

A spring 142 with an end in contact with a retainer 147 urges the valve 135 of the discharge valve 130 in a closed position against the seat 132. A spring 144 with an end against a retainer 146 urges the valve member 137 of the suction valve in a closed position against the seat 134. Both retainers 146, 147 are bolted with bolts 149 to the body 102.

The sleeve 170 is interiorly tapered to correspond to the exterior taper of the valve seat 102. Blind flanges 650*b* (see FIG. 13B) close off the bores 32*p*.

Figures 10A, 10B, 10C:
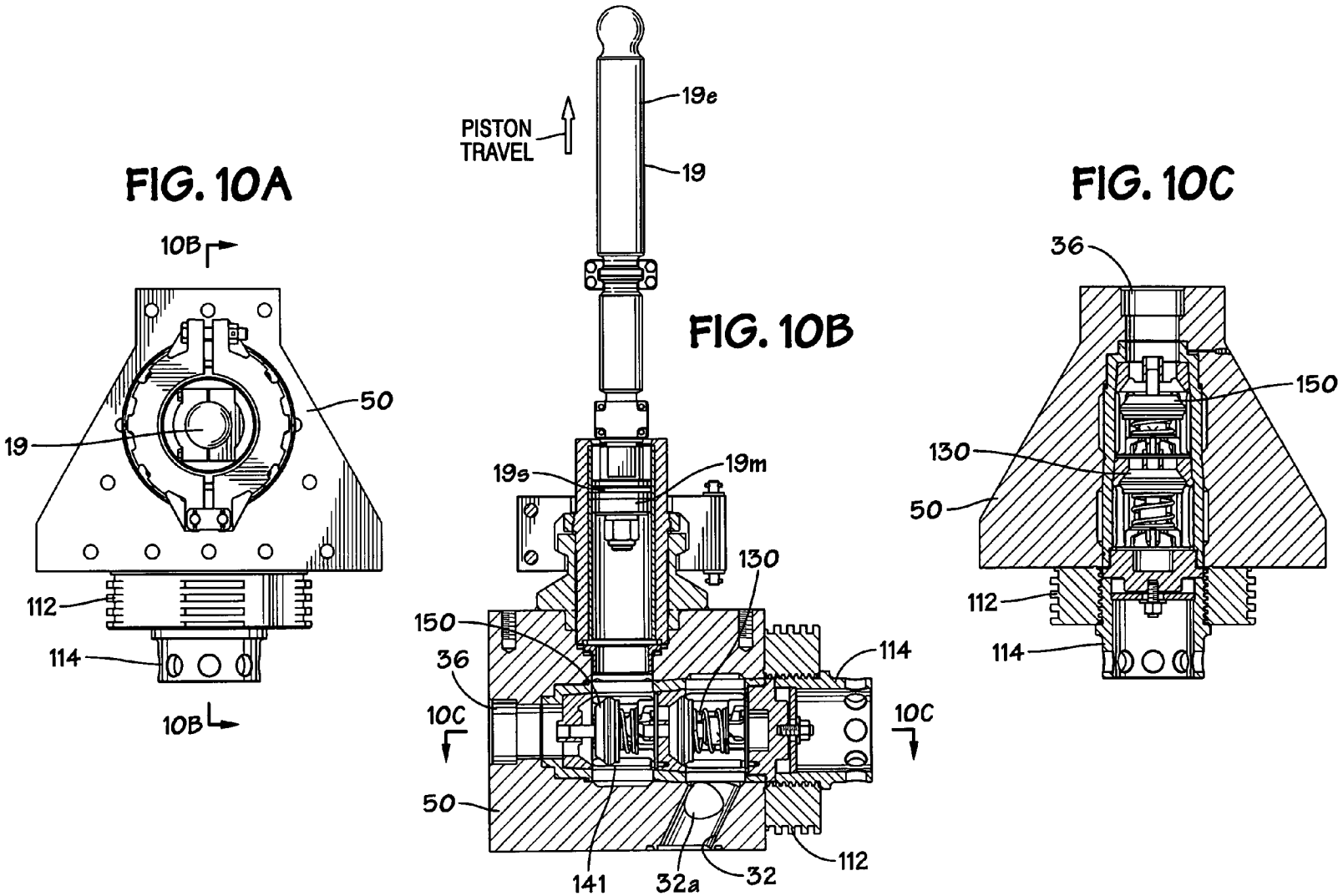
FIG. 10A is a top view of a module according to the present invention of the system of FIG. 3A.
FIG. 10B is side cross-section view of a portion of the system of FIG. 3A.
FIG. 10C is a top cross-section view of the module of FIG. 10A.

FIGS. 10A-10C illustrate a suction stroke of a pump assembly 100. The piston 19 is moved up (see FIG. 10B) by action of the hydraulic lift cylinders (see FIG. 3C) reducing the pressure on the piston side of the suction valve 150, overcoming the force (e.g. about 25 psi) of the spring 144, and resulting in unseating of the valve member 137 so that fluid is pumped into the module 50 through the inlet 36. Initially, the pressure on both sides of the valve member 137 is equal (e.g. about 100 psi) until the piston moves. The discharge valve 130 remains closed and the interior space of the module, a pump chamber 141, around the suction valve 150 is filled with fluid.

Figures 11A, 11B, 11C:
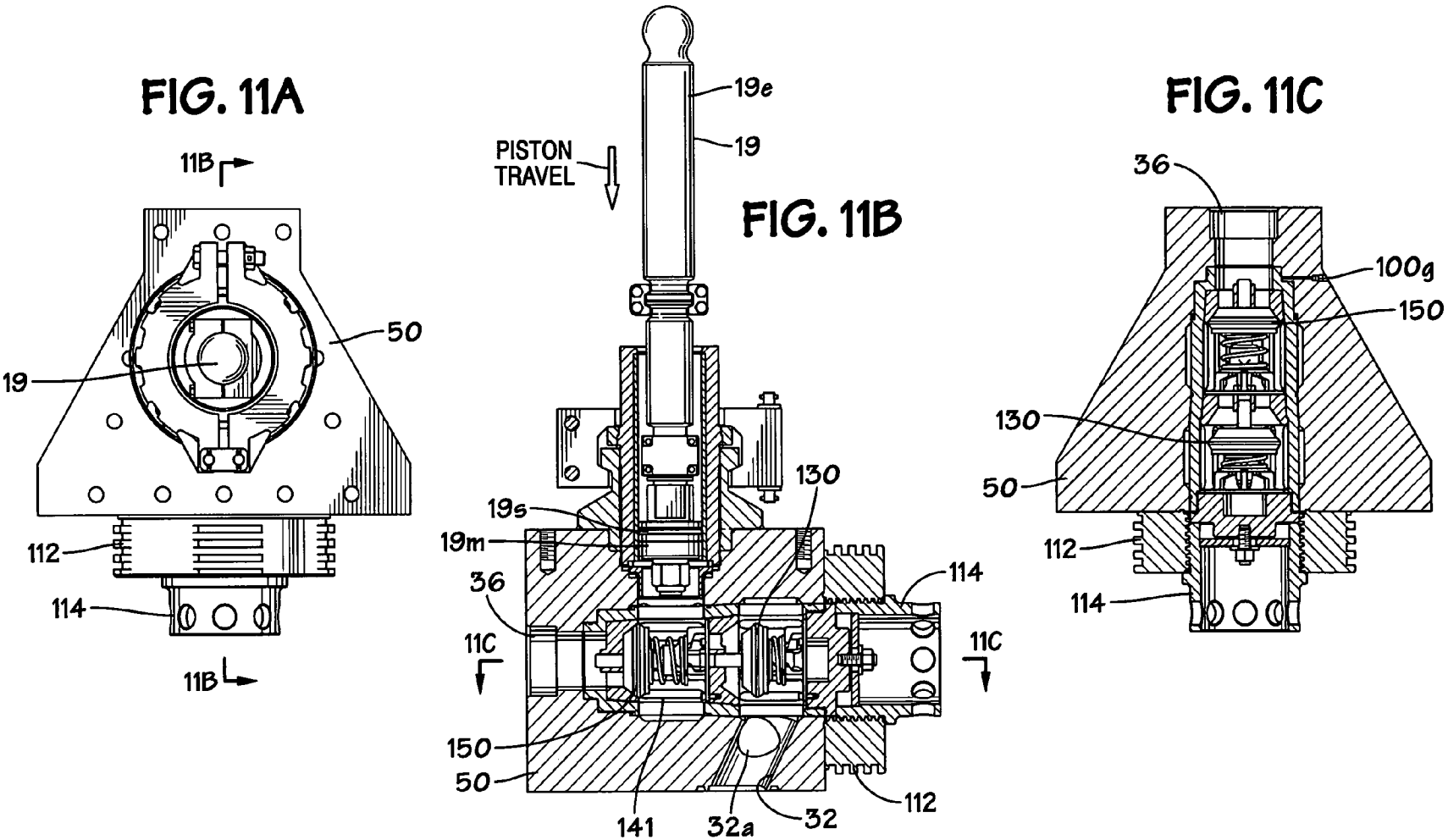
FIG. 11A is a top view of a module according to the present invention of the system of FIG. 3A.
FIG. 11B is side cross-section view of a portion of the system of FIG. 3A.
FIG. 11C is a top cross-section view of the module of FIG. 10A.

FIGS. 11A-11*c* illustrate a discharge stroke of the pump assembly 100. The piston 19 moves down forcing the discharge valve member 135 to unseat opening the discharge valve 130. The piston 19 moves down to force the fluid from the module 50 and out the discharge outlet 32 (see FIG. 11B).

Due to the tapers of the body 102 and the sleeve 170, by removing the nut 114, the plate 116 and the cap 104, the body 102 with the valves therein is removable from the body 502 of the module 50 and the sleeve 170 is removable from the body 502. In a typical embodiment, the pump assembly's discharge pressure is e.g. about 7500 psi, e.g. 7526 psi. Tapered sleeve 170 is force fit into the module to seal the sleeve against the interior of the module. Such a force fit pre-expands the module 50, e.g. 0.03 to 0.04 inches, thereby pre-stress an area around the O-ring 136 so the O-ring cannot move and, when under stress, does not scuff against the body 502. During installation lubricant is used to prevent galling. The sleeve 170 and its internal components (including the seats 102 and 134) are removed and installed as a complete assembly. Optionally a discharge valve alone can be removed with the complete assembly removed, the inner parts of valves and seats can be inspected without disassembling the entire assembly.

In one aspect a sleeve 170 is about ¾ inches thick and is made from alloy steel.

Figure 12B:
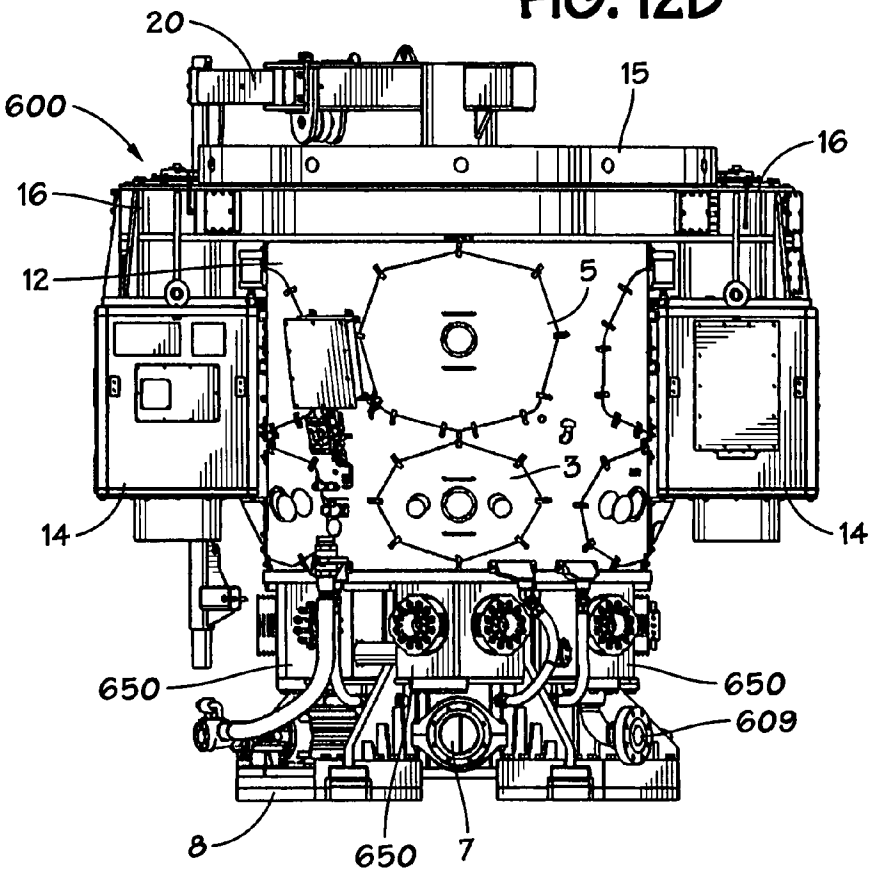
FIG. 12B is front view of the system of FIG. 12A.
Figure 12A:
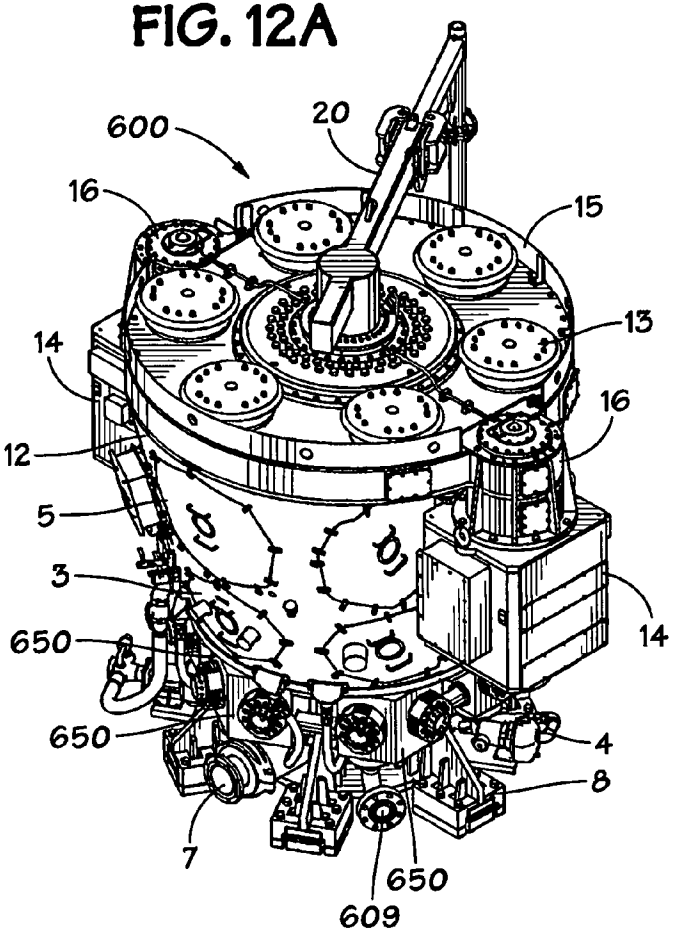
FIG. 12A is a perspective view of a system according to the present invention.
Figure 17A:
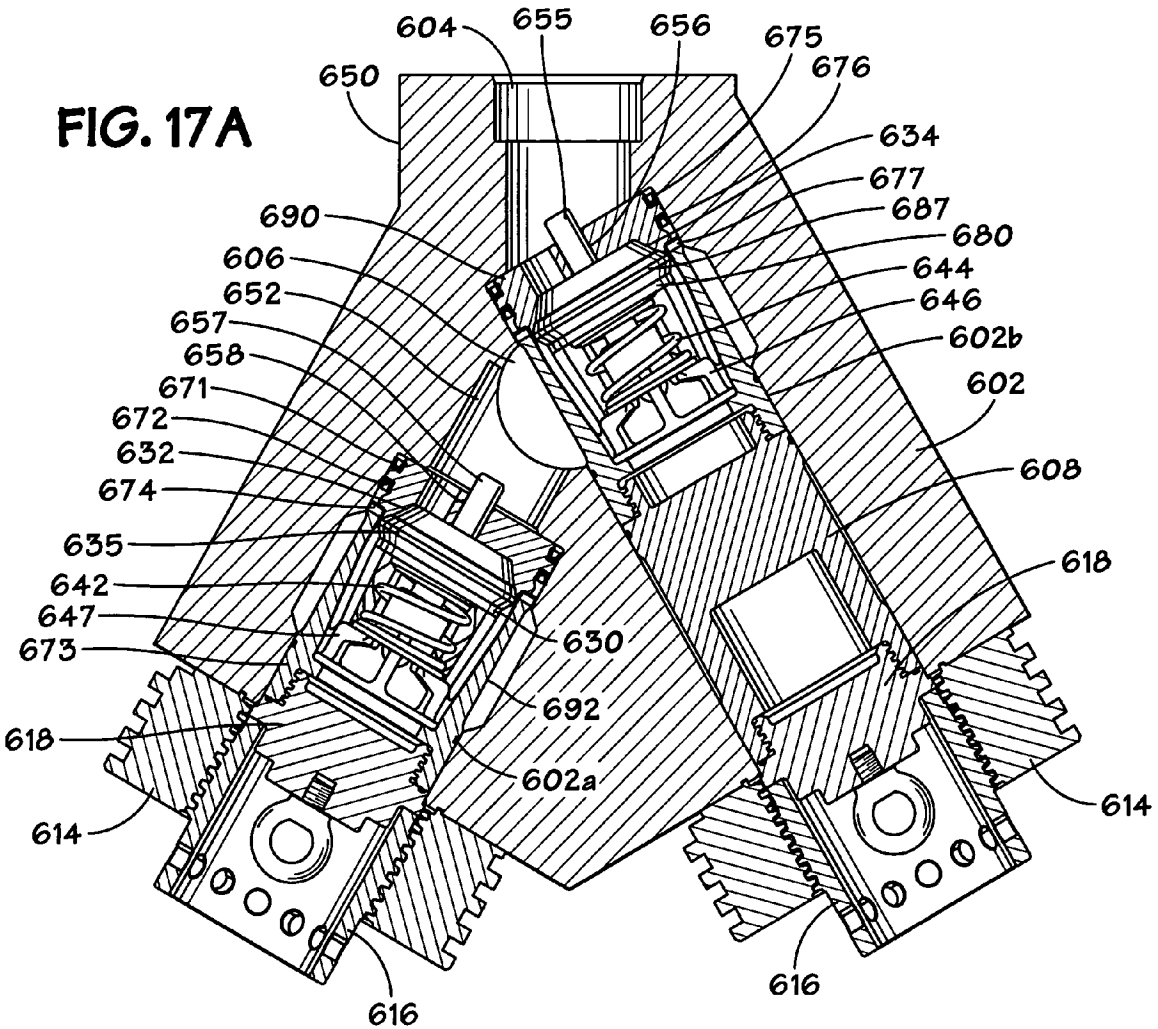
FIG. 17A is a cross-section view of a module according to the present invention of the system of FIG. 12A.
Figure 17B:
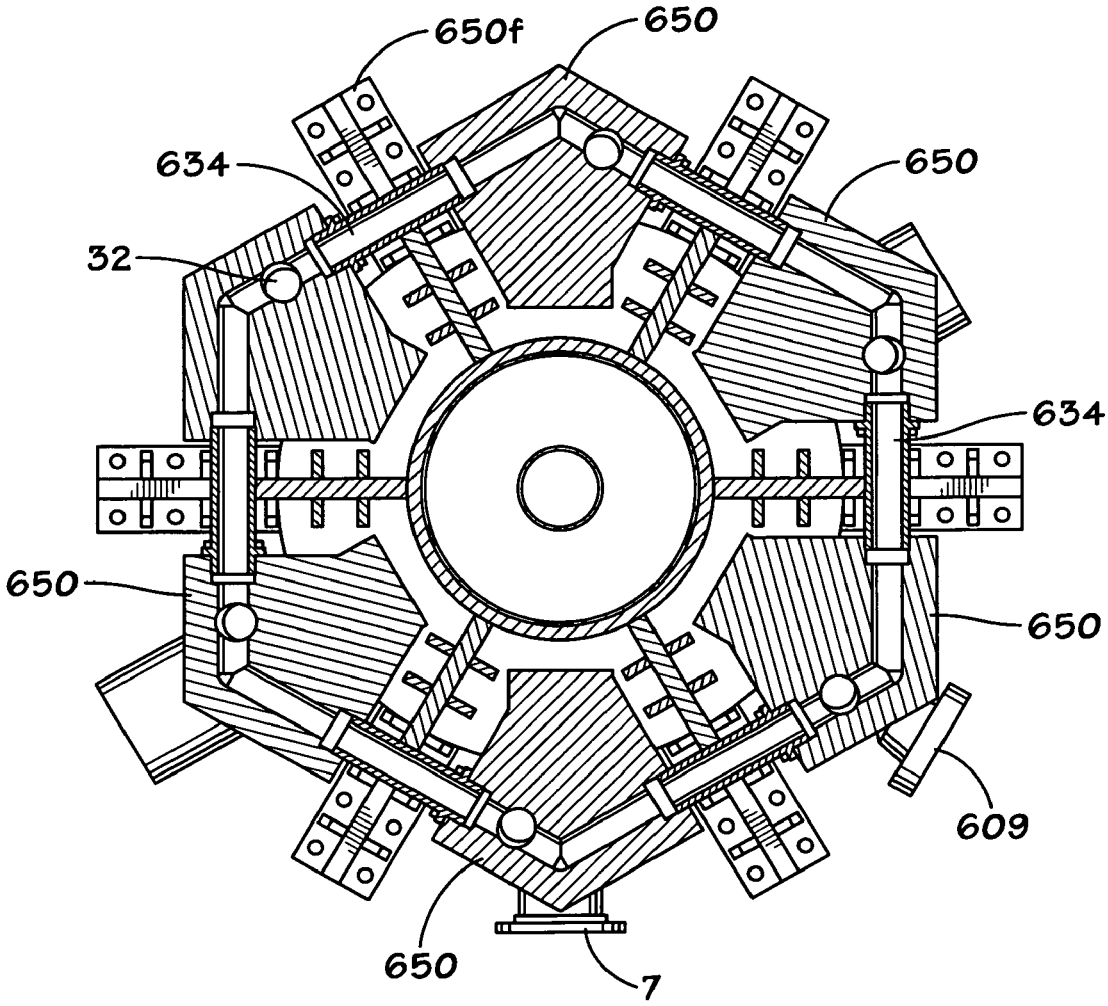
FIG. 17B is a cross-section view of part of the system of FIG. 13A.

FIGS. 12A and 12B show a system 600 like the system 10 (like numerals indicate like parts). The system 600 has modules 650 (see also FIG. 17A, FIG. 17B) which are different from the modules 50.

Figure 13C:
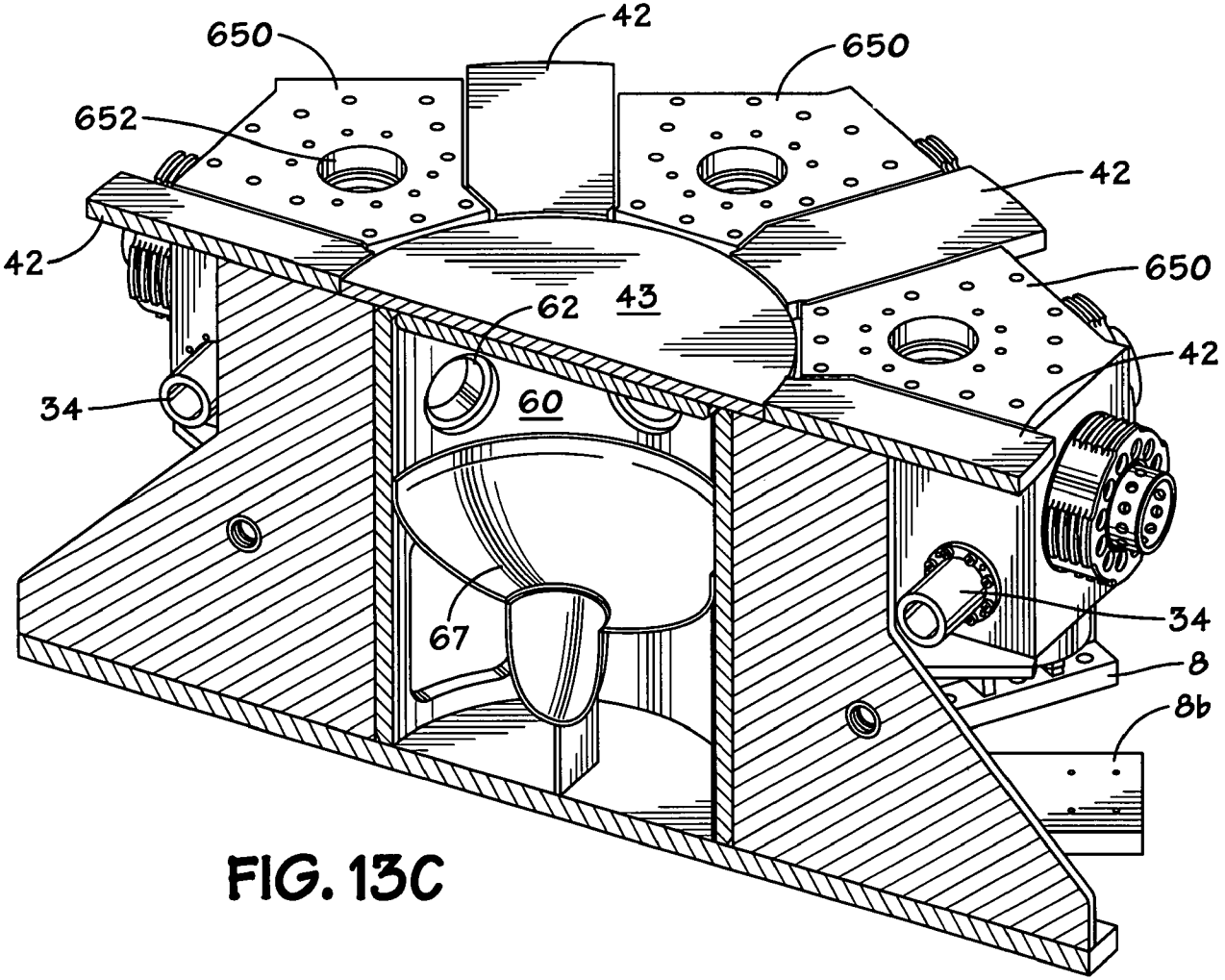
FIG. 13C is a partial cutaway view of the system of FIG. 12A.
Figure 14A:
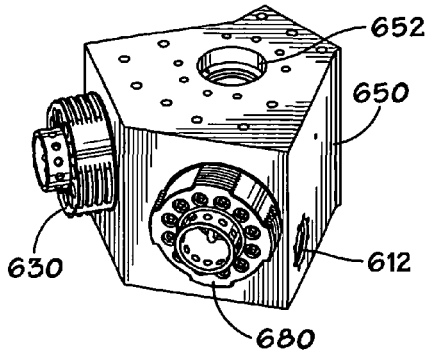
FIG. 14A is a front top perspective view of a module of the system of FIG. 3A.
Figure 14B:
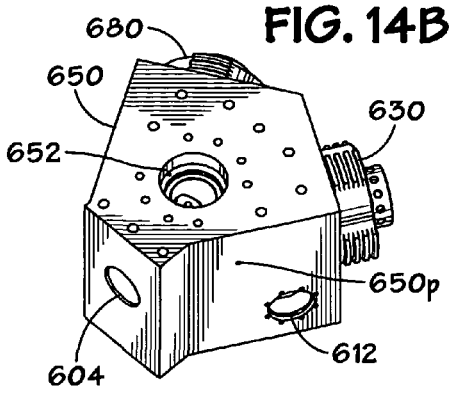
FIG. 14B is a rear top perspective view of the module of FIG. 14A.
Figure 14C:
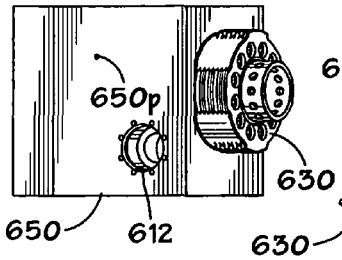
FIG. 14C is a left (as viewed in FIG. 14A) side view of the module of FIG. 14A.
Figure 14D:
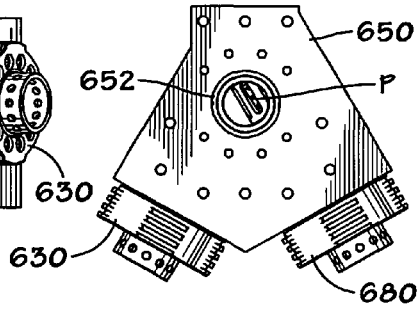
FIG. 14D is a top view of the module of FIG. 14A.
Figure 14E:
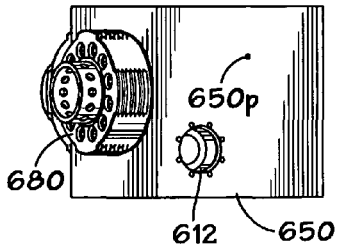
FIG. 14E is a right (as viewed in FIG. 14A) side view of the module of FIG. 14A.
Figure 14F:
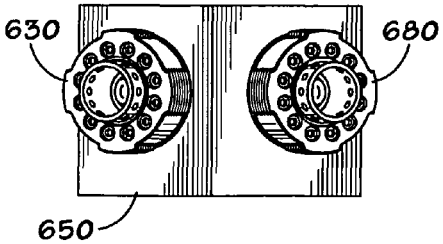
FIG. 14F is a front view of the module of FIG. 14A.
Figure 14G:
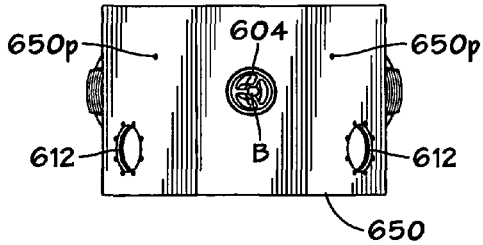
FIG. 14G is a front view of the module of FIG. 14A.
Figure 14H:
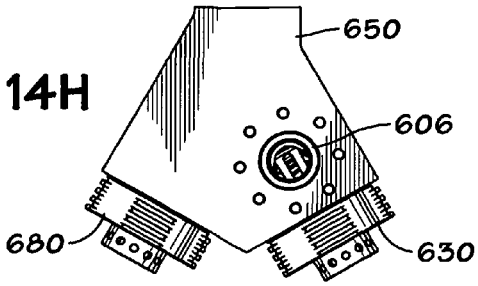
FIG. 14H is a front view of the module of FIG. 14A.
Figure 15A:
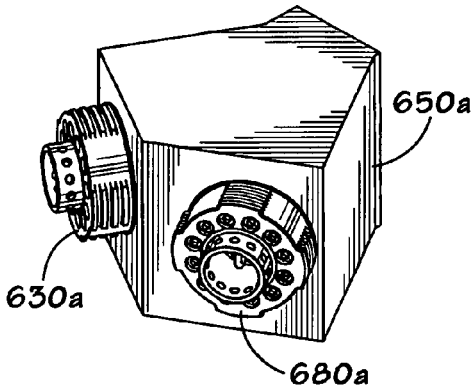
FIG. 15A is a front top perspective view of a module according to the present invention.
Figure 15B:
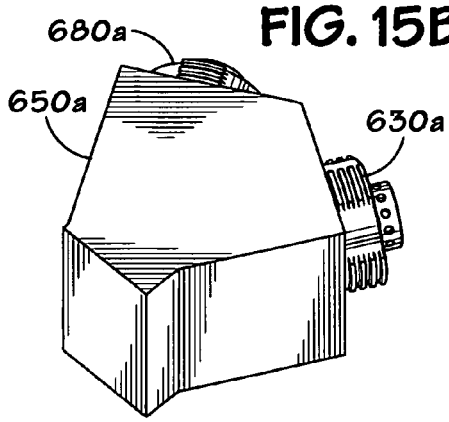
FIG. 15B is a rear top perspective view of the module of FIG. 15A.
Figure 15C:
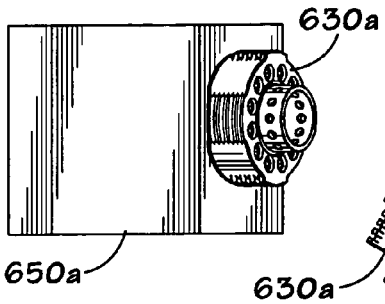
FIG. 15C is a left (as viewed in FIG. 15A) side view of the module of FIG. 15A.
Figure 15D:
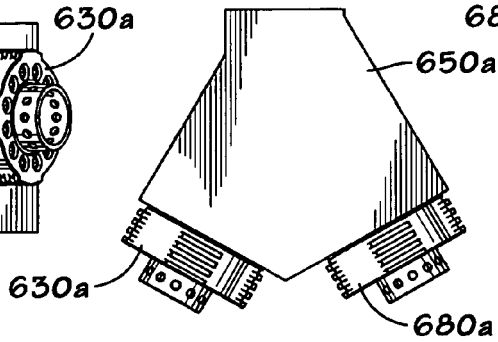
FIG. 15D is a top view of the module of FIG. 15A.
Figure 15E:
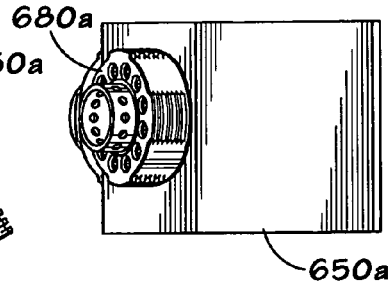
FIG. 15E is a right (as viewed in FIG. 15A) side view of the module of FIG. 15A.
Figure 15F:
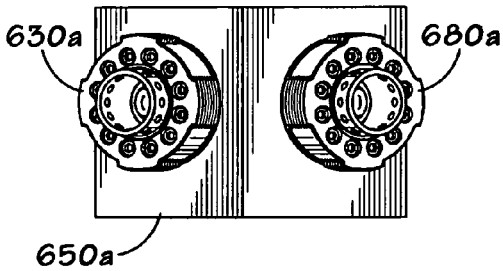
FIG. 15F is a front view of the module of FIG. 15A.
Figure 15G:
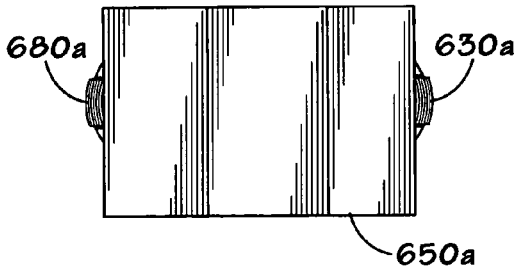
FIG. 15G is a front view of the module of FIG. 15A.
Figure 15H:
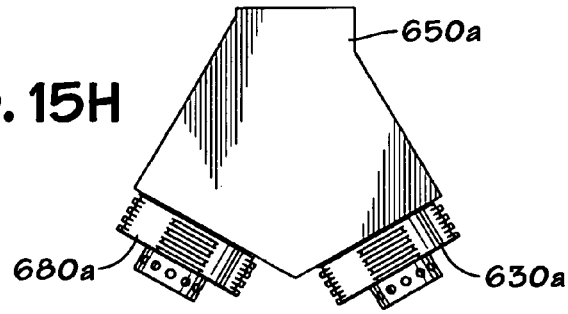
FIG. 15H is a front view of the module of FIG. 15A.
Figure 16A:
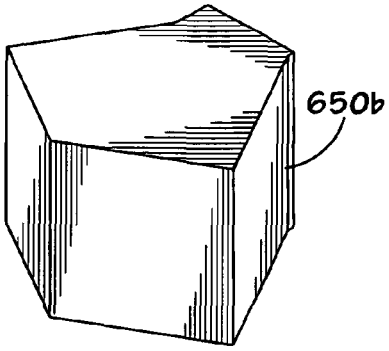
FIG. 16A is a front top perspective view of a module body according to the present invention.
Figure 16B:
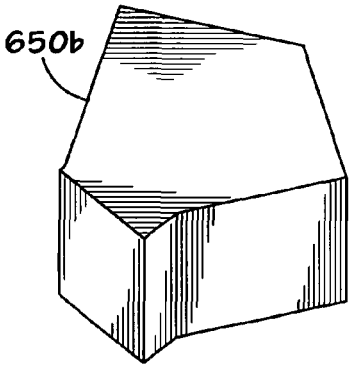
FIG. 16B is a rear top perspective view of the module body of FIG. 16A.
Figure 16C:
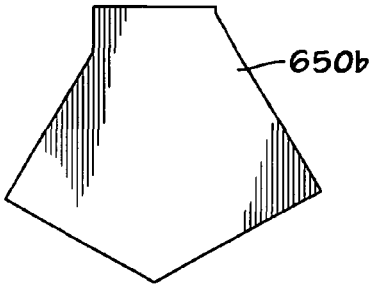
FIG. 16C is a top view of the module body of FIG. 16A.
Figure 16D:
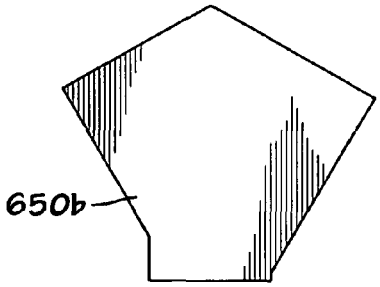
FIG. 16D is a bottom view of the module body of FIG. 16A.
Figure 16E:
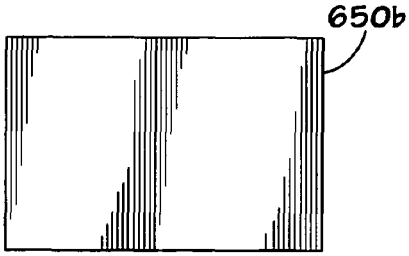
FIG. 16E is a front view of the module body of FIG. 16A.
Figure 16F:
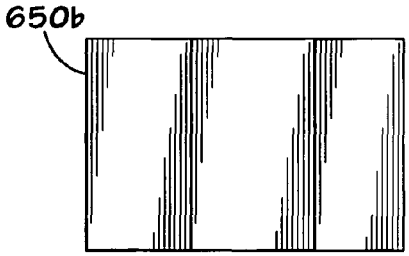
FIG. 16F is a rear view of the module body of FIG. 16A.
Figure 16G:
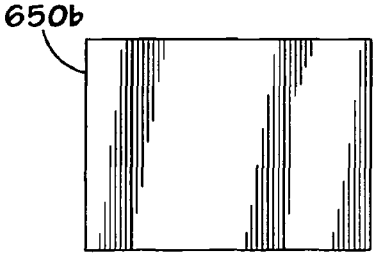
FIG. 16G is a left (as viewed in FIG. 16A) side view of the module body of FIG. 16A.
Figure 16H:
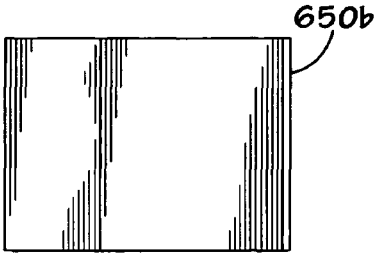
FIG. 16H is a right (as viewed in FIG. 16A) side view of the module body of FIG. 16A.

The modules 650 have a body 602 with a multi-part bore 604 therethrough from an exterior end of the body 602 to an interior end. The body 602 has a first bore 602*a* and a second bore 602*b*. Optional bleed ports 650*p* are provided. A discharge valve assembly 630 is in the bore 602*a* and a suction valve assembly 680 is in the bore 602*b*. The bore 602*a* is at an angle to the bore 602*b* (e.g. an acute angle ranging between 20 degrees and 45 degrees and, in one aspect, about 30 degrees). With a piston (like the piston 19, FIG. 3C) fluid is pumped into a chamber 652 of the module 650 via an inlet port 604 and is discharged from the module 650 into a discharge conduit 634 via an outlet port 606. The outlet ports 606 are in fluid communication with side ports 612 which are in fluid communication with the discharge conduits 634. The discharge conduits 634 are in fluid communication with a main outlet 609 providing a fluid communication path between all the modules on the discharge side of the pump. All the modules have their discharge outlets located so that they collect fluid after it passes their discharge valves and passes through their discharge conduits on the way to the discharge outlet 609 (FIG. 13A). A backside B of a suction valve seat is visible in FIG. 14G. Part P of the valve case of the valve assembly is visible in FIG. 14D. One module is selected at installation time as the best location for a discharge outlet. The other modules then have a blind flange 650*b* installed at the outlet port to secure the port.

Optionally, lug rings 614, like the lug ring 112, FIG. 9A; nuts 616, like the nut 114, FIG. 9A; and caps 618, like the cap 104, FIG. 9A, are used to hold the valve assemblies in their bores. The valve assemblies 630, 680 are removable from the bores 602*a*, 602*b*, respectively.

A spring 642 with an end in contact with a retainer 647 urges a valve member 635 of the discharge valve assembly 630 in a closed position against a seat 632. A spring 644 with an end against a retainer 646 urges a valve member 687 of the suction valve assembly 680 in a closed position against a seat 634. The retainers 646, 647 abut shoulders 641, 643, respectively. A guide shaft 657 of the discharge valve assembly 630 connected to the valve member 635 moves in a corresponding channel 658 in a valve body 692 to guide the valve member 635. A guide shaft 655 of the suction valve assembly 680 connected to the valve member 687 moves in a corresponding channel 656 in a valve body 690 to guide the valve member 687. A spacer 608 makes it possible for a variety of assembly cartridges to be interchangeable in the modules 650 as either suction valves or discharge valves.

Seals 671, 672, 673, 674 seal the interfaces indicated between the valve body 692 and an interior surface of the bore 602*a*. Seals 675, 676, 677 seal the indicated interfaces between the valve body 690 and an interior surface of the bore 602*b*. A flange 650*f* is used to bolt the fluid end of the pump to the deck.

Figures 18A, 18B, 18C:
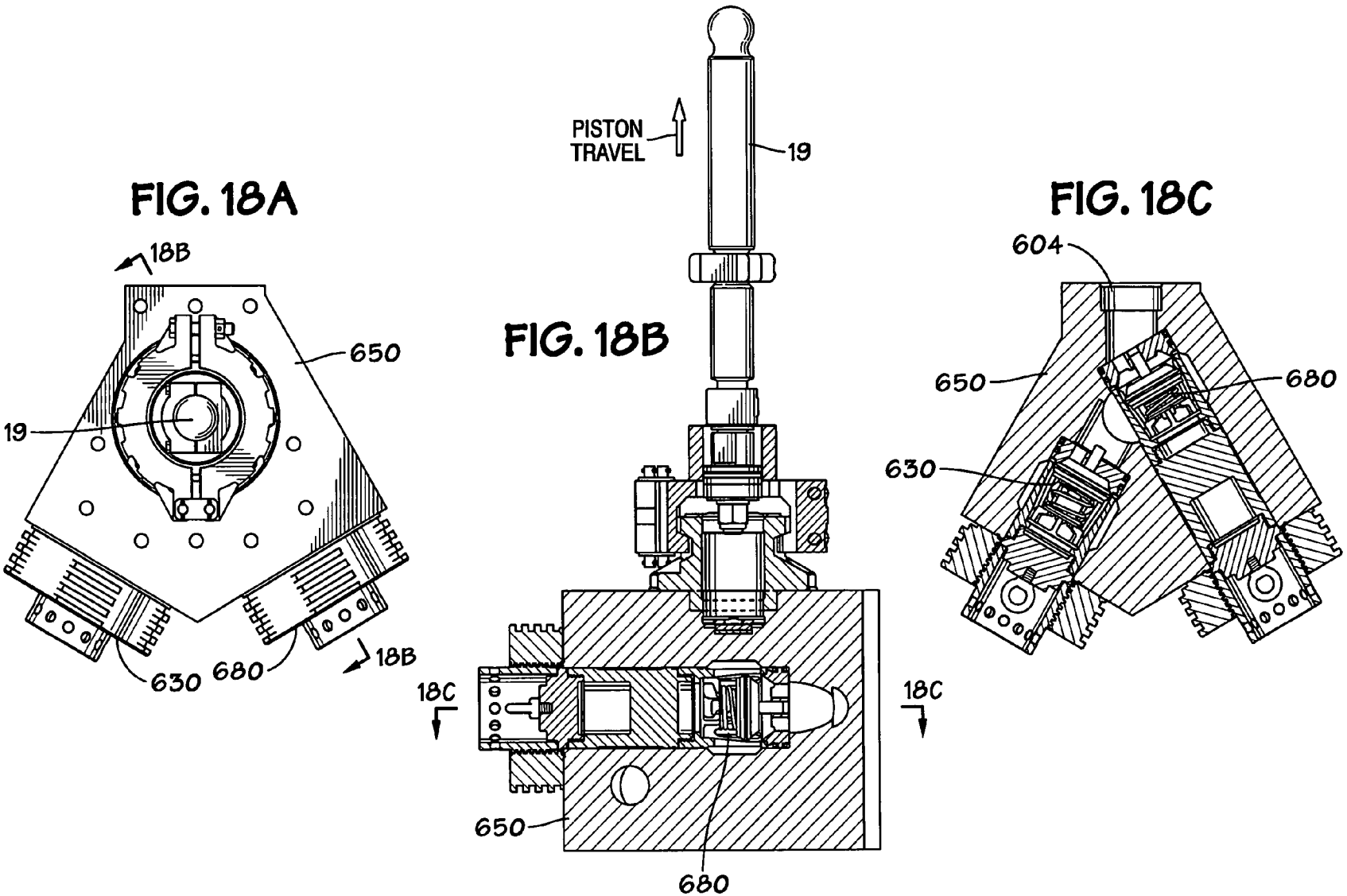
FIG. 18A is a top view of a module according to the present invention of the system of FIG. 3A.
FIG. 18B is side cross-section view of a portion of the system of FIG. 3A.
FIG. 18C is a top cross-section view of the module of FIG. 18A.

FIGS. 18A-18C illustrate a suction stroke of a pump system with modules 650.

The piston 19 (e.g. as in a system like that of FIG. 3C) is moved up by action of a drive gear reducing the pressure on the piston side of the suction valve assembly 680, overcoming the force (e.g. about 25 psi) of the spring 644, and resulting in unseating of the valve member 687 so that fluid is pumped into the module 650 through the inlet 604. Initially, the pressure on both sides of the valve member 687 is equal (e.g. about 100 psi). The discharge valve 630 remains closed and the interior pump chamber of the module around the suction valve assembly 680 is filled with fluid.

Figures 19A, 19B, 19C:
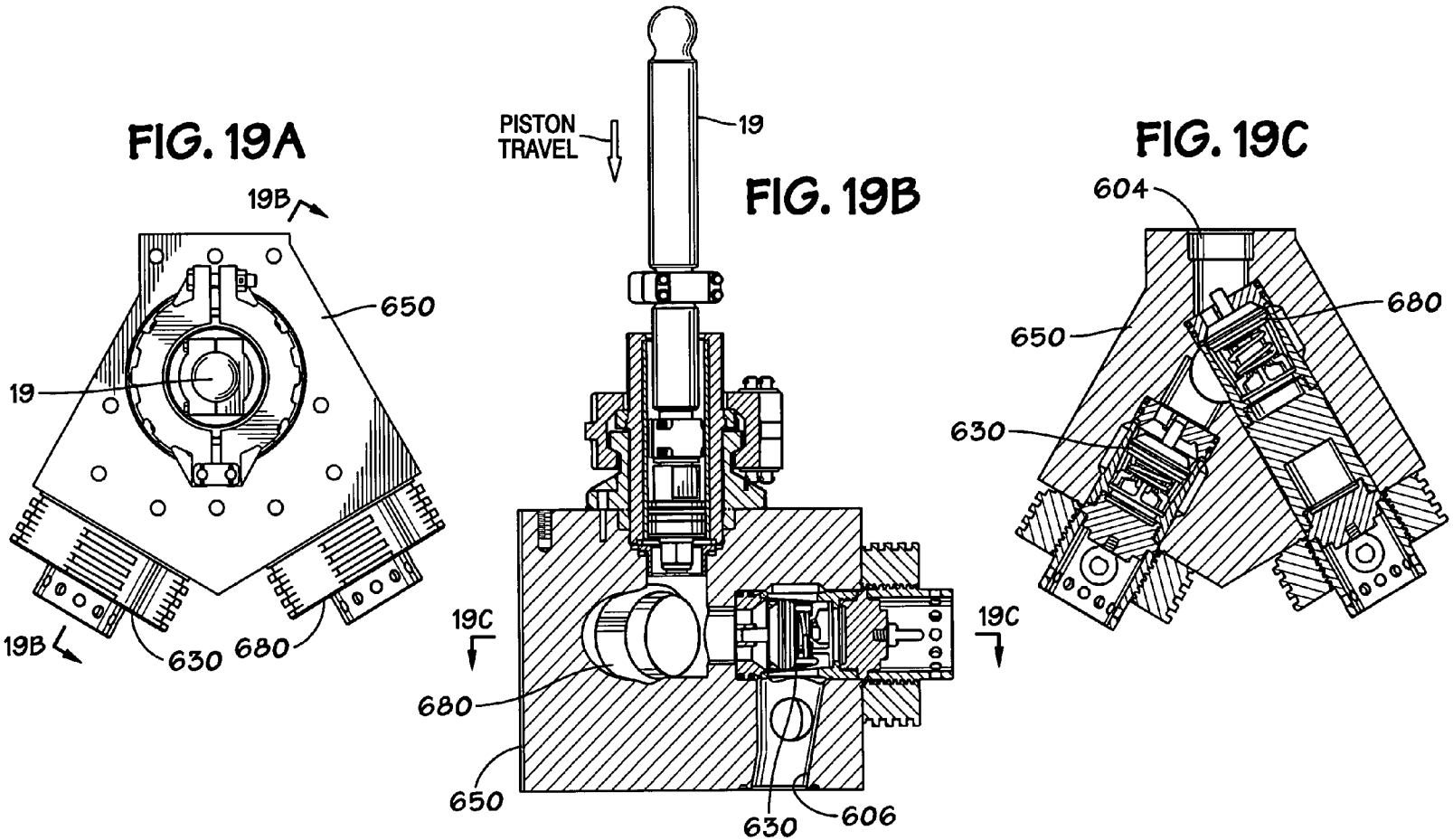
FIG. 19A is a top view of a module according to the present invention of the system of FIG. 3A.
FIG. 19B is side cross-section view of a portion of the system of FIG. 3A.
FIG. 19C is a top cross-section view of the module of FIG. 19A.

FIGS. 19A-19C illustrate a discharge stroke of the system 600. The piston 19 moves down forcing the discharge valve member 635 to unseat opening the discharge valve 630. The piston 19 moves down to force the fluid from the module 50 and out the discharge outlet 606.

FIGS. 15A-15H illustrate a module 650*a* according to the present invention, like the module 650, with no side or top openings other than openings of interior channels for two valve assemblies 630*a* and 680*a*. Side and top openings, are to be added as needed.

FIGS. 16A-16H show a design for a module body 650*b* according to the present invention for use as a module in fluid pumping systems. In certain aspects of the systems of the present invention, relatively thicker module housings are used which allow for the modules to be manufactured from less expensive, more readily available material (e.g. AISI8630M alloy steel instead of, e.g. S165M stainless steel). Thicker modules reduce the deflection of a module due to pressure variation. Reduced lower deflection of the housings improves cartridge seal life.

In many prior systems, the discharge leaves each module separately and is transferred by an S-pipe to a discharge ring. Designs, according to the present invention, eliminate the discharge ring and S-pipe by incorporating a discharge conduit which provides a common communication of mud through the modules.

In various systems according to the present invention described above, positioning the liner wash water transfer pump under the fluid modules removes the pump as a tripping hazard while consolidating liner wash drain lines within the pump support. On an upgrade power end design, in certain aspects, the drain line comes through the bottom of the chamber further reducing clutter. With the drains for the individual liner wash chambers positioned inboard so that they pass through the bottom plate rather than around it, the liner wash drain lines are positioned so that other components are more readily accessible.

In certain aspects, placing the lube oil pump under the fluid modules reduces the suction line (item 2, FIG. 3A) length to the lube oil pump.

Figure 20:
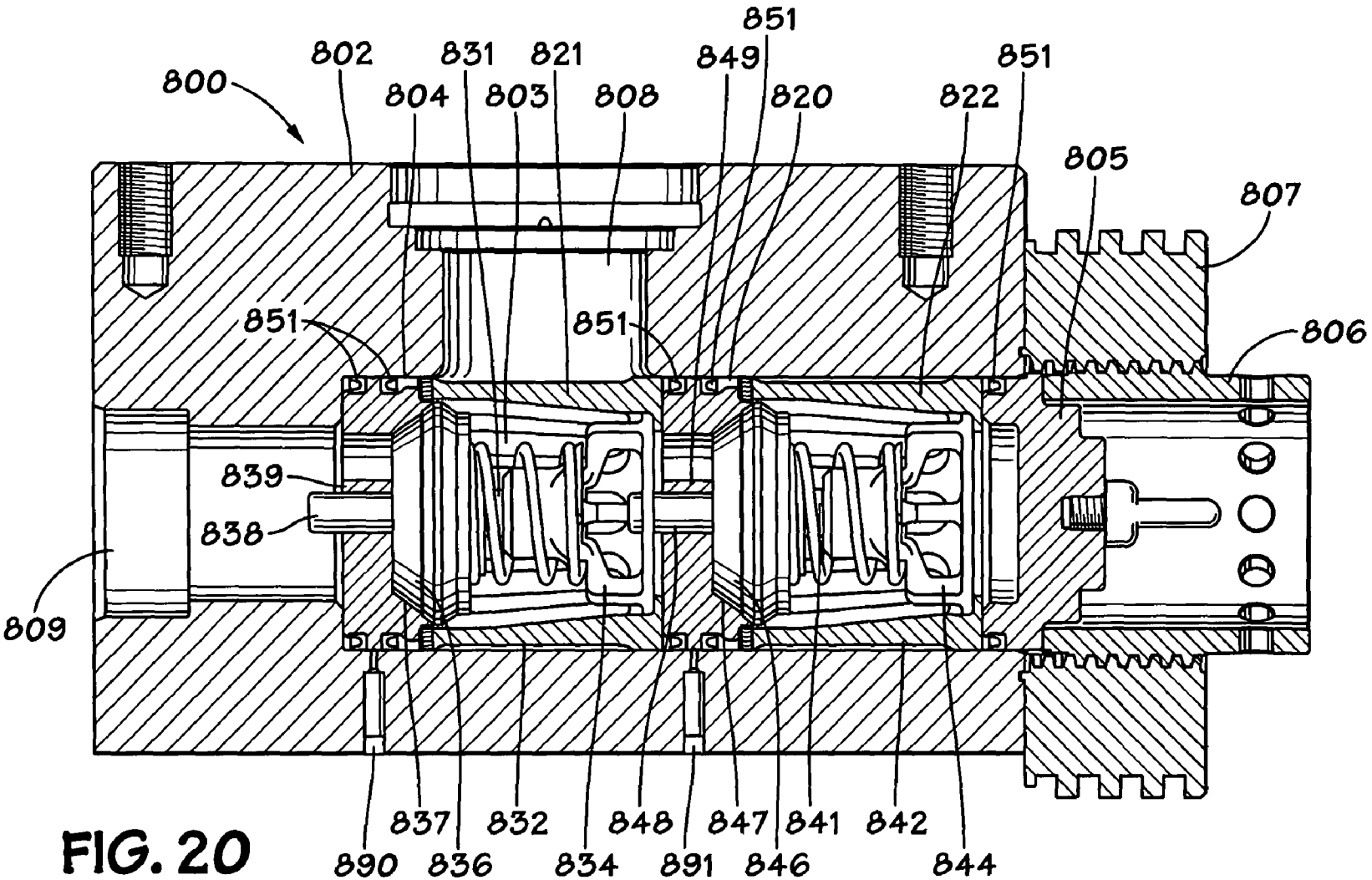
FIG. 20 is a cross-section view of a module according to the present invention.

FIG. 20 (a cross-section view) illustrates a module 800 according to the present invention for a drilling fluid pumping system with a valve assembly 820 according to the present invention in a body or "cage" 801. The module 800, in one aspect, has a body 802 with a wall thickness of at least two inches and a bore 804. The body (or "cage") 801 has slots 803. The valve assembly 820 includes cartridges 821, 822 removably positioned in the bore 804 and held in place with a cap 805, a nut 606, and a lug ring 807. The valve cartridges 821, 822 as shown are, but need not be, the same. In certain aspects, as is true with any module according to the present invention, the wall thickness of the modules 800 is greater than 2.36" and, in one particular aspect, is 3.75".

The valve cartridge 821 acts as a suction valve and the valve cartridge 822 acts as a discharge valve. A piston (not shown, like the piston 19 described above) moves up and down (as does the piston 18) in a port 808 to pump fluid in through an inlet 809 and out through a discharge port (not shown in FIG. 20) out of the side of the body 802.

The valve cartridge 821 has a body 832, a retainer 834 connected to the body 801, a valve member 836 movable toward and away from a seat 837, and a guide shaft 838 connected to the valve member 836 that moves in a corresponding channel 839 in the body (or "cage") 801. A guide shaft 831 moves in a corresponding channel (not shown) of the retainer 834. The valve member 836 can move to the right (as seen in FIG. 20) in the body 801.

The valve cartridge 822 has a body 842, a retainer 844 connected to the body 842, a valve member 846 movable toward and away from a seat 847, and a guide shaft 848 connected to the valve member 846 that moves in a corresponding channel 849 in the body 842. A guide shaft 841 moves in a corresponding channel (not shown) of the retainer 844. The valve member 846 can move to the right, as shown in FIG. 20, in the body or cage 842. O-rings 851, 852, 853, 854 and 855 seal the interfaces at their locations.

In a typical sequence of operation, the piston moves up opening the suction valve assembly 821 to pump fluid through the inlet port 809 into the bore 804. Then the piston moves down, closing in the suction valve assembly 821 and opening the discharge valve assembly 822 to pump fluid out of the module 800 through the discharge port 811. Weep holes 890 and 891 prevent a pressure build up behind the seals which could prevent the seals from energizing correctly. The weep holes are used in cartridge valve versions according to the present invention.

FIG. 21A shows a system 900 according to the present invention like the system of FIGS. 3A and 4A (and like numerals indicate like parts). Instead of the modules 50, the system 900 has removable modules 950. As shown in FIG. 21B, discharge outlets 952 of each module 950 communicate with each other via a discharge conduit 954 which itself is in fluid communication with a main system outlet 909. Fluid communication with the discharge conduit 954 is via the outlets 952. In certain aspects, such design allows the benefits of the previous designs to be incorporated in an existing pump base, thus allowing for existing pumps to be fitted with a module according to the present invention with thicker walls and with the discharge conduit.

Figure 21E:
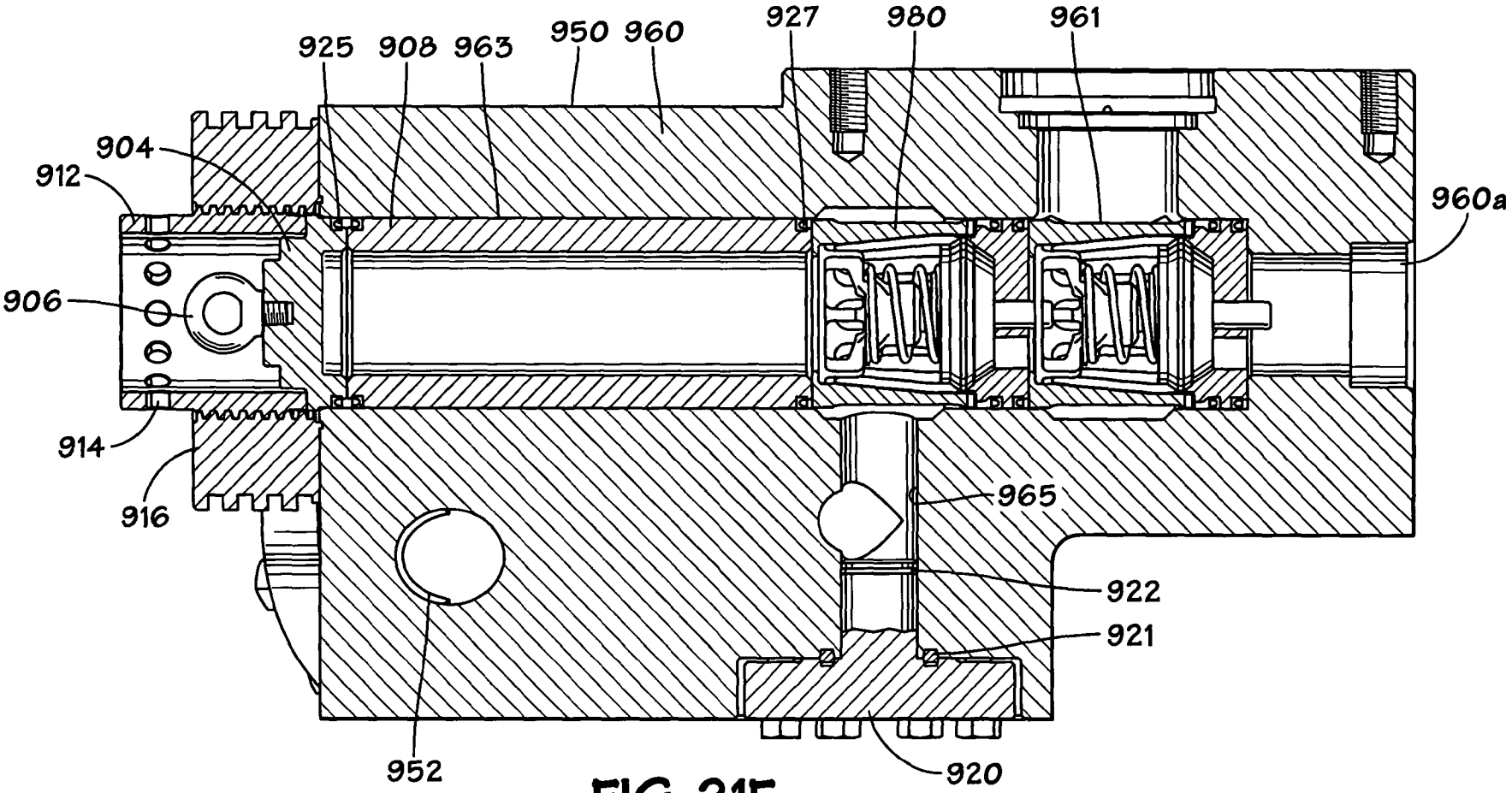
FIG. 21E is a cross-section view of the module of FIG. 21D along line E-E of FIG. 21I.

As shown in FIG. 21C and in FIGS. 21D-21J, each module 950 has a body 960 with a valve assembly 980 removably mounted in a pump chamber 961. The valve assembly 980 may be any valve assembly disclosed herein according to the present invention and, in one aspect, is as shown in FIG. 21D.

A cover 904 with an eyebolt 906 holds a spacer 908 in place in a bore 963 in the body 960. A cap 912 with optional wrenching openings 914 threadedly engages a lug ring 916 to hold the cover 904, etc. in place. The lug ring 916 is connected to the body 960.

Piston apparatuses 19*a* (e.g. like the apparatuses 19 as in FIGS. 10A-11C) pumps fluid into and out of the chamber 961.

A blind flange 920 closes off a bore 965 in the body 960. A gasket 921 seals a flange-body interface and a seal 922 seals a flange-bore interface. Seals 925, 927 seal a spaced-body interface.

The body 960 has an opening 960*a* which provides an inlet passage. The modules 950 (as are any modules disclosed herein according to the present invention) are removable from the system 900 by unbolting the discharge conduit, removing the liner, and unbolting the modules from the pump base. A blind flange 991 covers a discharge conduit 992 which may, upon removal of the flange 991, be a main discharge for the system.

FIGS. 22A-22H show a module 950.

FIGS. 23A-23H show a module 950*a*.

It is within the scope of the present invention for any module according to the present invention to be made from one large integral main body with the various holes, channels, bores, etc. formed therein. It is within the scope of the present invention for any module according to the present invention to be made from multiple pieces (two, three, or more) to form the main body. Such pieces may be bolted and/or welded together. For example, as shown in FIGS. 24A-24G, a module 1000 according to the present invention has a body 1004 made of a top piece 1001 bolted with bolts 1006 to a bottom piece 1002.

A blind flange 1008 selectively closes off a discharge conduit 1009 (as does the blind flange 991, FIG. 21D). A valve assembly 1012 is like any valve assembly according to the present invention, e.g., but not limited to, like the valve assembly 980, FIG. 21E. A discharge conduit 1014 is, e.g., like the conduit 952, FIG. 21E. A cover 1016 is like the cover 904, FIG. 21E; a cap 1018 is like the cap 912, FIG. 21E; and a lug ring 1020 is like the lug ring 916, FIG. 21E. An inlet 1024 is like the inlet 960*a*, FIG. 21E. A bone 1026 is like the bore 965, FIG. 21E. A cap 1028 is like the cap 912, FIG. 21E. Channels, bores, openings, and holes are provided for the module 1000 like those of the module 950, FIG. 21E.

Figure 24A:
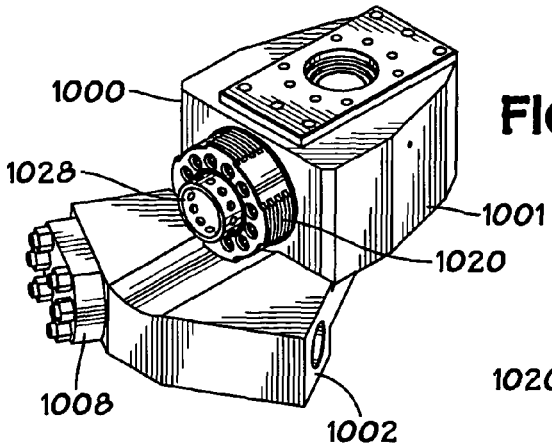
FIG. 24A is a front top perspective view of a module according to the present invention.
Figure 24B:
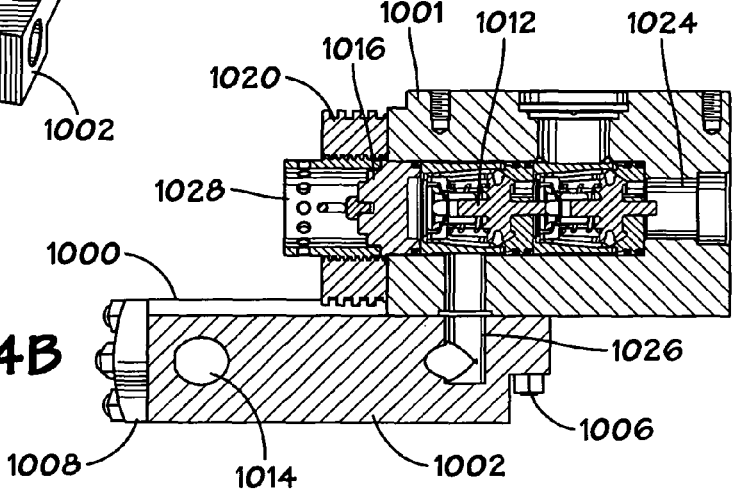
FIG. 24B is a cross-section perspective view of the module of FIG. 24A along line B-B of FIG. 24D.
Figure 24C:
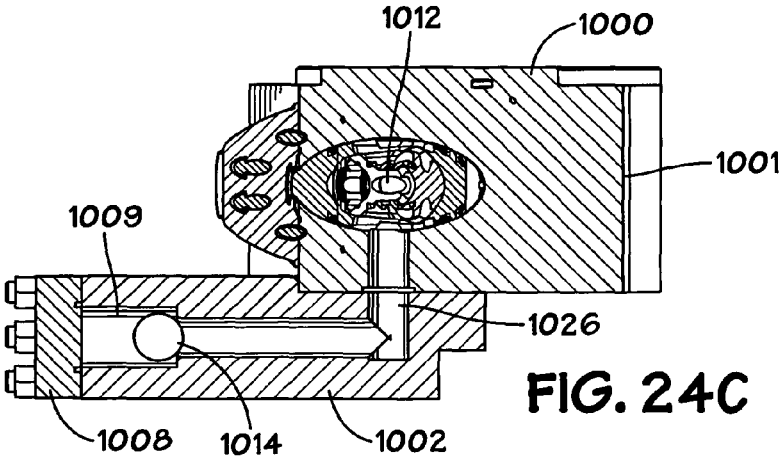
FIG. 24C is a cross-section view of the module of FIG. 24A along line C-C of FIG. 24E.
Figure 24D:
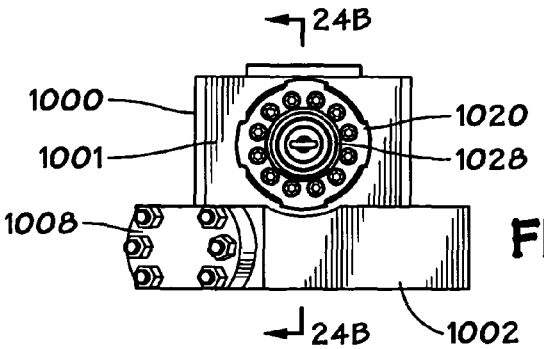
FIG. 24D is a front view of the module of FIG. 24A.
Figure 24E:
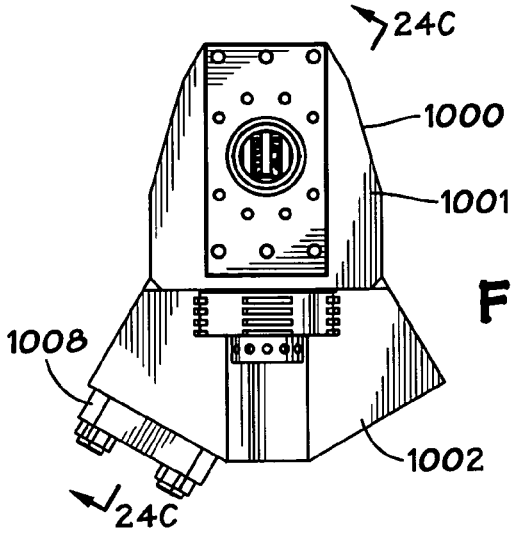
FIG. 24E is a top view of the module of FIG. 24A.
Figure 24F:
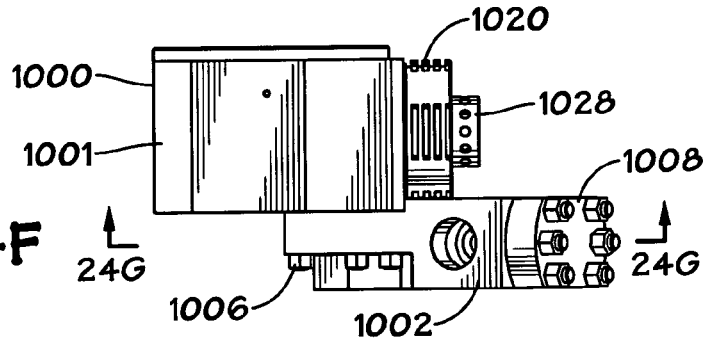
FIG. 24F is a side view of the module of FIG. 24A.
Figure 24G:
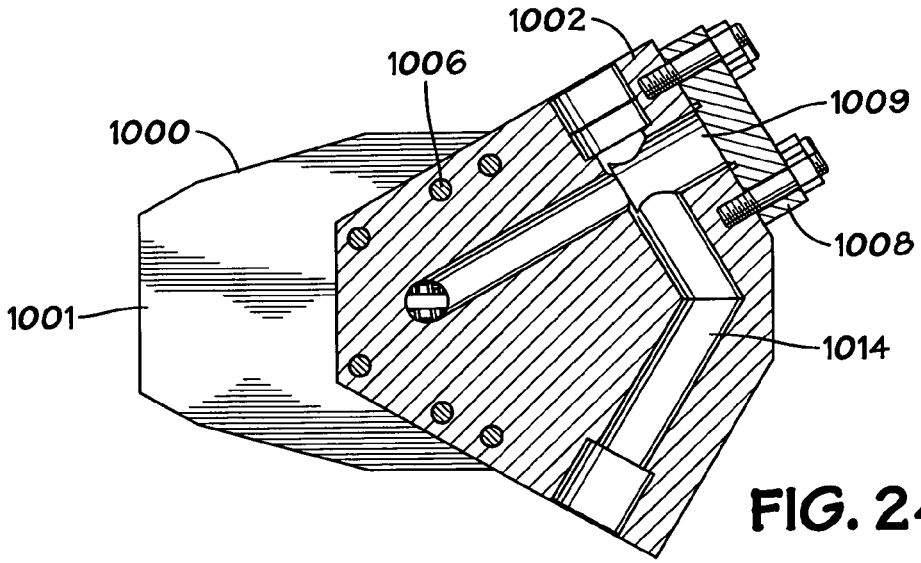

FIGS. 25A-25G illustrate a module body according to the present invention which a top piece 1011 (similar to the top piece 1001, FIG. 24A) and a bottom piece 1012 (similar to the bottom piece 1002, FIG. 24A).

The present invention, therefore, provides in at least some embodiments, systems for pumping drilling fluid, the systems including: a base; a plurality of pumping apparatuses connected to the base, including a first pumping apparatus, each pumping apparatus including a pumping module with a module body; pumping structure for pumping fluid to and from each module; a conduit apparatus between each pair of adjacent modules so that fluid discharged from each module is flowable to the first pumping apparatus and into the module of the first pumping apparatus for discharge; and a main outlet for receiving fluid pumped by all the pumping apparatuses.

The present invention, therefore, provides in at least some embodiments, a system for pumping drilling fluid, the system including: a base; a plurality of pumping apparatuses connected to the base, each pumping apparatus including a pumping module with a module body, each module body having a fluid inlet, a pumping chamber, a pumping chamber opening and a fluid discharge outlet, the fluid inlet in fluid communication with the pumping chamber, and a valve assembly in the module body for controlling fluid flow from the fluid inlet and through the pumping chamber to the fluid discharge outlet, the valve assembly passable through the pumping chamber opening into and out of the pumping chamber, pumping structure for pumping fluid to and from each pumping module; a main outlet for receiving fluid pumped by the pumping apparatuses; the plurality of pumping apparatuses including a first pumping apparatus, the main outlet at the first pumping apparatus of the plurality of pumping apparatuses, the first pumping apparatus's module comprising a first module, the first pumping apparatus's fluid discharge outlet comprising a first fluid discharge outlet, the first fluid discharge outlet in fluid communication with the main outlet; and a conduit apparatus between the fluid discharge outlets of each pair of adjacent modules so that fluid discharged from each module is flowable to the first pumping apparatus and into the first module for discharge through the main outlet. Such a system according to the present invention may have one or some (in any possible combination) of the following: wherein the conduit apparatuses are connectible between adjacent modules following installation of the modules on the base; each module having a main discharge bore so that any of the plurality of pumping apparatuses may be the pumping apparatus with the first pumping system; a base inlet apparatus in fluid communication with each fluid inlet of each pumping apparatus, the base inlet having an entry for receiving drilling fluid to be provided to each fluid inlet of each pumping apparatus; the base inlet includes a central channel member in fluid communication with each fluid inlet of each pumping apparatus, the central channel member having an entry port at a second level, and the fluid inlets of each pumping apparatus at a first level, the first level above the second level; a suction dampener adjacent the entry of the base inlet for dampening fluid flow therethrough providing fluid at a substantially constant pressure to the fluid inlets of the pumping apparatuses; each module body having module walls of sufficient thickness to reduce breathing of the module due to pressure variation; wherein the thickness of each module wall is greater than 2.36 inches; wherein the thickness of each module wall is at least 3.75 inches; and/or wherein each module body includes two parts bolted together, the two parts including a top part housing the valve assembly, and a bottom part having the fluid discharge outlet.

The present invention, therefore, provides in at least some embodiments, a system for pumping drilling fluid through a wellbore extending into the earth, the system including: a base; a plurality of pumping apparatuses connected to the base, each pumping apparatus including a pumping module with a module body, each module body having a fluid inlet, a pumping chamber, a pumping chamber opening and a fluid discharge outlet, the fluid inlet in fluid communication with the pumping chamber, and a valve assembly in the pumping chamber for controlling fluid flow from the fluid inlet and through the pumping chamber to the fluid discharge outlet, the valve assembly passable through the pumping chamber opening into and out of the pumping chamber, pumping structure for pumping fluid to and from each module; a main outlet for receiving fluid pumped by the pumping apparatuses; the plurality of pumping apparatuses including a first pumping apparatus, the main outlet at the first pumping apparatus of the plurality of pumping apparatuses, the first pumping apparatus's module comprising a first module, the first pumping apparatus's fluid discharge outlet comprising a first fluid discharge outlet, the first fluid discharge outlet in fluid communication with the main outlet; a conduit apparatus between the fluid discharge outlets of each pair of adjacent modules so that fluid discharged from each module is flowable to the first pumping apparatus and into the first module for discharge through the main outlet; wherein the conduit apparatuses are connectible between adjacent modules following installation of the modules on the base; each module having a main discharge bore so that any of the plurality of pumping apparatuses may be the pumping apparatus with the first pumping system; a base inlet apparatus in fluid communication with each fluid inlet of each pumping apparatus; the base inlet having an entry for receiving drilling fluid to be provided to each fluid inlet of each pumping apparatus; the base inlet including a central channel member in fluid communication with each fluid inlet of each pumping apparatus; the central channel member having an entry port at a second level; and the fluid inlets of each pumping system at a first level, the first level above the second level. Such a system according to the present invention may have one or some (in any possible combination) of the following: a suction dampener adjacent the entry of the base inlet for dampening fluid flow therethrough providing fluid at a substantially constant pressure to the fluid inlet of the pumping apparatus; and/or wherein the thickness of each module wall is at least 3.75 inches.

The present invention, therefore, provides in at least some embodiments, a system for pumping drilling fluid through a wellbore extending into the earth, the system including: a base; a plurality of pumping apparatuses connected to the base, each pumping apparatus including a pumping module with a module body, each module body having a fluid inlet, a pumping chamber, a pumping chamber opening and a fluid discharge outlet, the fluid inlet in fluid communication with the pumping chamber, and a valve assembly in the module body for pumping drilling fluid from the fluid inlet and through the pumping chamber to the fluid discharge outlet, pumping structure for pumping fluid to and from each module, the valve assembly including a suction valve and a discharge valve; the module body having a suction valve bore housing the suction valve; and the module body having a discharge valve bore housing the discharge valve. Such a system according to the present invention may have one or some (in any possible combination) of the following: a suction valve opening in the module body at an outer end of the suction valve bore, the suction valve passable through the suction valve opening for insertion into and removal from the suction valve bore, and a discharge valve opening in the module body at an outer end of the discharge valve bore, the discharge valve passable through the discharge valve opening for insertion into and removal from the suction valve bore; and/or wherein the suction valve bore is at an angle to the discharge valve bore.

The present invention, therefore, provides in at least some embodiments, a system for pumping drilling fluid through a wellbore extending into the earth, the system including: a base; a plurality of pumping apparatuses connected to the base, each pumping apparatus including a pumping module with a module body, the module body having a fluid inlet, a pumping chamber, a pumping chamber opening and a fluid discharge outlet, the fluid inlet in fluid communication with the pumping chamber, a valve assembly bore in the module body, and a valve assembly in the valve assembly bore for controlling fluid flow from the fluid inlet, through the pumping chamber, and to the fluid discharge outlet, the valve assembly passable into and out of the valve assembly bore, pumping structure for pumping fluid to and from each module; the valve assembly bore having a first tapered area; the valve assembly having a second tapered area; and the second tapered area sealingly abutting the first tapered area and such a system wherein the valve assembly bore includes a removable sleeve encompassing the valve assembly and the first tapered area is on the removable sleeve.

The present invention, therefore, provides in at least some embodiments, a method for pumping drilling fluid through a wellbore extending into the earth, the method including: pumping drilling fluid to a primary system for providing drilling fluid to a wellbore, the primary system being any pumping system according to the present invention, the method further comprising pumping drilling fluid from a fluid inlet of each pumping system to a main outlet and from the main outlet into the wellbore, then pumping the drilling fluid from the wellbore; and such a method wherein conduit apparatuses are connectible between adjacent modules following installation of the modules on the base, the method further comprising pumping drilling fluid from each module to a single one of the pumping apparatus, and pumping drilling fluid from the single one pumping apparatus to the main outlet. [0212] In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A system for pumping drilling fluid, the system comprising a base, a plurality of pumping apparatuses connected to the base, wherein each pumping apparatus comprises a pumping module, each pumping module comprises a module body, and each module body comprises a pumping chamber, a module body outlet, and a discharge flow channel between a pumping chamber outlet and the module body outlet, pumping structure for pumping fluid to and from each pumping module, a conduit apparatus between the module bodies of each pair of adjacent pumping modules, wherein each end of each conduit apparatus is in fluid communication with the discharge flow channel of a respective module body, and wherein each conduit apparatus is adapted to permit fluid that is discharged from each pumping module to flow into the pumping module of a first pumping apparatus of the plurality of pumping apparatuses for discharge from the pumping system, and a main outlet for receiving fluid pumped by all the pumping apparatuses wherein the main outlet is in fluid communication with the module body outlet of the first pumping module.

2. A system for pumping drilling fluid, the system comprising a base, a plurality of pumping apparatuses connected to the base, each pumping apparatus including a pumping module with a module body, each module body having a fluid inlet, a pumping chamber, a pumping chamber opening and a fluid discharge outlet, the fluid inlet in fluid communication with the pumping chamber, and a valve assembly in the module body for controlling fluid flow from the fluid inlet and through the pumping chamber to the fluid discharge outlet, the valve assembly passable through the pumping chamber opening into and out of the pumping chamber, pumping structure for pumping fluid to and from each pumping module, a main outlet for receiving fluid pumped by the pumping apparatuses, the plurality of pumping apparatuses including a first pumping apparatus, the main outlet at the first pumping apparatus of the plurality of pumping apparatuses, the first pumping apparatus's module comprising a first module, the first pumping apparatus's fluid discharge outlet comprising a first fluid discharge outlet, the first fluid discharge outlet in fluid communication with the main outlet, and a conduit apparatus between the fluid discharge outlets of each pair of adjacent modules so that fluid discharged from each module is flowable to the first pumping apparatus and into the first module for discharge through the main outlet.

3. The system of claim 2 wherein the conduit apparatuses are connectible between adjacent modules following installation of the modules on the base.

4. The system of claim 2 further comprising each module having a main discharge bore so that any of the plurality of pumping apparatuses may be the pumping apparatus with the first pumping system.

5. The system of claim 2 further comprising a base inlet apparatus in fluid communication with each fluid inlet of each pumping apparatus, the base inlet having an entry for receiving drilling fluid to be provided to each fluid inlet of each pumping apparatus.

6. The system of claim 5 wherein the base inlet includes a central channel member in fluid communication with each fluid inlet of each pumping apparatus, the central channel member having an entry port at a second level, and the fluid inlets of each pumping apparatus at a first level, the first level above the second level.

7. The system of claim 5 further comprising a suction dampener adjacent the entry of the base inlet for dampening fluid flow therethrough providing fluid at a substantially constant pressure to the fluid inlets of the pumping apparatuses.

8. The system of claim 2 further comprising each module body having module walls of sufficient thickness to reduce breathing of the module due to pressure variation.

9. The system of claim 2 wherein the thickness of each module wall is greater than 2.36 inches.

10. The system of claim 2 wherein the thickness of each module wall is at least 3.75 inches.

11. The system of claim 2 wherein each module body includes two parts bolted together, the two parts including a top part housing the valve assembly, and a bottom part having the fluid discharge outlet.

12. A system for pumping drilling fluid through a wellbore extending into the earth, the system comprising a base, a plurality of pumping apparatuses connected to the base, each pumping apparatus including a pumping module with a module body, each module body having a fluid inlet, a pumping chamber, a pumping chamber opening and a fluid discharge outlet, the fluid inlet in fluid communication with the pumping chamber, and a valve assembly in the pumping chamber for controlling fluid flow from the fluid inlet and through the pumping chamber to the fluid discharge outlet, the valve assembly passable through the pumping chamber opening into and out of the pumping chamber, pumping structure for pumping fluid to and from each module, a main outlet for receiving fluid pumped by the pumping apparatuses, the plurality of pumping apparatuses including a first pumping apparatus, the main outlet at the first pumping apparatus of the plurality of pumping apparatuses, the first pumping apparatus's module comprising a first module, the first pumping apparatus's fluid discharge outlet comprising a first fluid discharge outlet, the first fluid discharge outlet in fluid communication with the main outlet, a conduit apparatus between the fluid discharge outlets of each pair of adjacent modules so that fluid discharged from each module is flowable to the first pumping apparatus and into the first module for discharge through the main outlet, wherein the conduit apparatuses are connectible between adjacent modules following installation of the modules on the base, each module having a main discharge bore so that any of the plurality of pumping apparatuses may be the pumping apparatus with the first pumping system, a base inlet apparatus in fluid communication with each fluid inlet of each pumping apparatus, the base inlet having an entry for receiving drilling fluid to be provided to each fluid inlet of each pumping apparatus, the base inlet including a central channel member in fluid communication with each fluid inlet of each pumping apparatus, the central channel member having an entry port at a second level, and the fluid inlets of each pumping system at a first level, the first level above the second level.

13. The system of claim 12 further comprising a suction dampener adjacent the entry of the base inlet for dampening fluid flow therethrough providing fluid at a substantially constant pressure to the fluid inlet of the pumping apparatus.

14. The system of claim 12 wherein the thickness of each module wall is at least 3.75 inches.

15. A system for pumping drilling fluid through a wellbore extending into the earth, the system comprising a base, a plurality of pumping apparatuses connected to the base, each pumping apparatus including a pumping module with a module body, each module body having a fluid inlet, a pumping chamber, a pumping chamber opening and a fluid discharge outlet, the fluid inlet in fluid communication with the pumping chamber, and a valve assembly in the module body for pumping drilling fluid from the fluid inlet and through the pumping chamber to the fluid discharge outlet, pumping structure for pumping fluid to and from each module, the valve assembly including a suction valve and a discharge valve, the module body having a suction valve bore housing the suction valve, and the module body having a discharge valve bore housing the discharge valve.

16. The system of claim 15 further comprising a suction valve opening in the module body at an outer end of the suction valve bore, the suction valve passable through the suction valve opening for insertion into and removal from the suction valve bore, and a discharge valve opening in the module body at an outer end of the discharge valve bore, the discharge valve passable through the discharge valve opening for insertion into and removal from the suction valve bore.

17. The system of claim 16 wherein the suction valve bore is at an angle to the discharge valve bore.

18. A system for pumping drilling fluid through a wellbore extending into the earth, the system comprising a base, a plurality of pumping apparatuses connected to the base, each pumping apparatus including a pumping module with a module body, the module body having a fluid inlet, a pumping chamber, a pumping chamber opening and a fluid discharge outlet, the fluid inlet in fluid communication with the pumping chamber, a valve assembly bore in the module body, and a valve assembly in the valve assembly bore for controlling fluid flow from the fluid inlet, through the pumping chamber, and to the fluid discharge outlet, the valve assembly passable into and out of the valve assembly bore, pumping structure for pumping fluid to and from each module, the valve assembly bore having a first tapered area, the valve assembly having a second tapered area, and the second tapered area sealingly abutting the first tapered area.

19. The system of claim 18 wherein the valve assembly bore includes a removable sleeve encompassing the valve assembly and the first tapered area is on the removable sleeve.

20. A method for pumping drilling fluid through a wellbore extending into the earth, the method comprising pumping drilling fluid to a primary system for providing drilling fluid to a wellbore, the primary system comprising a base, a plurality of pumping apparatuses connected to the base, each pumping apparatus including a pumping module with a module body, each module body having a fluid inlet, a pumping chamber, a pumping chamber opening and a fluid discharge outlet, the fluid inlet in fluid communication with the pumping chamber, and a valve assembly in the module body for controlling fluid flow from the fluid inlet and through the pumping chamber to the fluid discharge outlet, the valve assembly passable through the pumping chamber opening into and out of the pumping chamber, pumping structure for pumping fluid to and from each module, a main outlet for receiving fluid pumped by the pumping apparatuses, the plurality of pumping apparatuses including a first pumping apparatus, the main outlet at the first pumping apparatus of the plurality of pumping apparatuses, the first pumping apparatus's module comprising a first module, the first pumping apparatus's fluid discharge outlet comprising a first fluid discharge outlet, the first fluid discharge outlet in fluid communication with the main outlet, and a conduit apparatus between the fluid discharge outlets of each pair of adjacent modules so that fluid discharged from each module is flowable to the first pumping apparatus and into the first module for discharge through the main outlet, the method further comprising pumping drilling fluid from the fluid inlet of each pumping system to the main outlet and from the main outlet into the wellbore, then pumping the drilling fluid from the wellbore.

21. The method of claim 20 wherein the conduit apparatuses are connectible between adjacent modules following installation of the modules on the base, the method further comprising pumping drilling fluid from each module body to a single one of the pumping apparatus, and pumping drilling fluid from the single one pumping apparatus to the main outlet.

22. The method of claim 20 wherein a base inlet apparatus is in fluid communication with each fluid inlet of each pumping system, the base inlet having an entry for receiving drilling fluid to be provided to each fluid inlet of each pumping system, the base inlet including a central channel member in fluid communication with each fluid inlet of each pumping system, the central channel member having an entry port at a second level, the fluid inlets of each pumping system at a first level, the first level above the second level, the method further comprising providing fluid at a substantially constant pressure to the fluid inlet of each pumping system.

23. The method of claim 22 wherein there is a suction dampener adjacent the entry of the base inlet for dampening fluid flow therethrough providing fluid at a substantially constant pressure to the fluid inlet of the pumping systems, the method further comprising dampening fluid flow through the base inlet.

* * * * *